US009178310B2

(12) United States Patent
Tsai

(10) Patent No.: US 9,178,310 B2
(45) Date of Patent: Nov. 3, 2015

(54) DUPLEX MALE ELECTRICAL CONNECTOR WITH A CONNECTION BOARD MOVABLE INSIDE A SOCKET SHELL

(76) Inventor: Chou Hsien Tsai, Taipei Hsien (TW)

( * ) Notice: Subject to any disclaimer, the term of this patent is extended or adjusted under 35 U.S.C. 154(b) by 0 days.

(21) Appl. No.: 13/483,182

(22) Filed: May 30, 2012

(65) Prior Publication Data

US 2013/0005193 A1 Jan. 3, 2013

Related U.S. Application Data

(60) Provisional application No. 61/530,256, filed on Sep. 1, 2011.

(30) Foreign Application Priority Data

| | | |
|---|---|---|
| Jun. 30, 2011 | (TW) | 100123202 A |
| Mar. 22, 2012 | (JP) | 2012-001571 |
| May 4, 2012 | (TW) | 101208439 A |

(51) Int. Cl.

| | |
|---|---|
| ***H01R 27/02*** | (2006.01) |
| ***H01R 31/00*** | (2006.01) |
| ***H01R 13/631*** | (2006.01) |
| ***H01R 31/06*** | (2006.01) |
| ***H01R 24/60*** | (2011.01) |

(52) U.S. Cl.

CPC ..... *H01R 13/6315* (2013.01); *H01R 24/60* (2013.01); *H01R 31/06* (2013.01)

(58) Field of Classification Search

CPC .... H01R 35/02; H01R 31/06; H01R 23/0256; H01R 35/00

USPC ..... 439/676, 108, 637, 607.01, 607.06

See application file for complete search history.

(56) References Cited

U.S. PATENT DOCUMENTS

| | | | | |
|---|---|---|---|---|
| 6,149,468 | A * | 11/2000 | Meng | 439/637 |
| 7,390,220 | B1 * | 6/2008 | Wu | 439/607.06 |
| 2010/0210124 | A1 * | 8/2010 | Li | 439/108 |
| 2011/0159746 | A1 * | 6/2011 | He | 439/660 |
| 2013/0115823 | A1 * | 5/2013 | Wu et al. | 439/660 |
| 2013/0130548 | A1 * | 5/2013 | Wu et al. | 439/607.01 |
| 2013/0130549 | A1 * | 5/2013 | Wu et al. | 439/607.01 |

* cited by examiner

*Primary Examiner* — Chandrika Prasad

(74) *Attorney, Agent, or Firm* — Pro-TECHTOR International Services; Ian Oglesby

(57) ABSTRACT

A duplex male electrical connector includes an insulating base, two rows of first connection contacts and a socket shell. The insulating base has a front section formed with a connection board. The connection board has opposite top and bottom surfaces. The two rows of first connection contacts are disposed on the top and bottom surfaces of the connection board, respectively. The socket shell is formed with a connection slot having a front end serving as an insert port. The connection board is disposed in the connection slot. The socket shell and the connection board can vertically float and move relative to each other, such that the connection board can vertically float and move relative to the socket shell or the socket shell can vertically float and move relative to the connection board.

18 Claims, 35 Drawing Sheets

DUPLEX MALE ELECTRICAL CONNECTOR WITH A CONNECTION BOARD MOVABLE INSIDE A SOCKET SHELL

BACKGROUND OF THE INVENTION

1. Field of the Invention

The invention relates to an electrical connector, and more particularly to a male electrical connector with a socket shell.

2. Related Art

At present, the most popular signal transmission specification for the computer apparatus is the universal serial bus (USB). A female connector socket and a transmission cable manufactured according to this specification can be immediately used to connect a peripheral apparatus, such as a mouse, a keyboard or the like, to the computer in a plug-and-play manner.

At present, the USB specifications contain USB 2.0 and USB 3.0 specifications. As shown in FIG. 1, an existing USB 2.0 male connector or plug 90 includes a plastic seat 91 and a metal casing 92 covering the plastic seat 91. A socket space 93 is formed between the metal casing 92 and the plastic seat 91. Only one surface of the plastic seat 91 is provided with one row of connection contacts 94 exposed to the socket space 93. At present, the official specifications of the USB association include the overall height "i" equal to 4.5 mm, the half height "j" of the socket space 93 equal to 2.25 mm, and the height "k" of the socket space equal to 1.95 mm. At present, the USB 2.0 female socket has an inner tongue having one surface provided with one row of connection contacts. In use, the USB 2.0 plug needs to be inserted in a correct direction to align the connection contacts of the plug and the socket with each other for electrical connection. In order to ensure the electrical connection upon the insertion of the USB plug, both the socket and the plug have the mistake-proof designs. As shown in FIG. 1A, when a mark 97 on one surface of a handle 96 connected to the USB 2.0 male connector 90 faces upwards, the connector 90 is in a forward state. At this time, the connection contacts 94 face upwards. When the male connector 90 is forwardly inserted, the electrical connection can be established, as shown in FIG. 1B. However, the USB plug cannot be reversely inserted so that the electrical connection cannot be established. The user usually randomly inserts the USB plug, so the possibility of insertion failure is equal to ½. So, the user often has to insert the plug twice in an inconvenient manner.

Referring to FIG. 2, an existing USB 2.0 female socket 80 includes a plastic seat 81, a metal casing 83 and one row of terminals 87. The front end of the plastic seat 81 is integrally formed with a horizontally extended tongue 82. The metal casing 83 is positioned at the front end of the plastic seat 81 to form a connection slot 84. The tongue 82 is disposed near the lower section of the connection slot 84. The one row of terminals 87 include four terminals fixed to the plastic seat 81 and extending frontward and arranged on the tongue 82, and a projecting connection contact 88 is formed near the distal end of the terminal 87.

The USB 2.0 female socket 80 has to provide the mistake-proof design in conjunction with the male connector, and the official specifications of the USB association are as follows: the height "o" of the connection slot is equal to 5.12 mm, the thickness "p" of the tongue is equal to 1.84 mm, the height "s" above the tongue is equal to 0.72 mm, and the height "q" below the tongue is equal to 2.56 mm. Thus, the USB 2.0 male connector 90 needs to be inserted with the connection contact 94 facing downwards, so that the socket space 93 and the tongue 82 can be fitted and positioned with each other, wherein the half height "j" (2.25 mm) is inserted into the height "q" (2.56 mm) below the tongue. If the USB 2.0 male connector 90 is reversed, it cannot be inserted.

As shown in FIG. 2A, an existing USB 3.0 female socket 85 has the associated dimensions and structure substantially the same as those of the USB 2.0 female socket 80 except for the difference that the tongue 82 of the USB 3.0 female socket 85 is longer and the front section of the USB 3.0 female socket 85 is provided with five second connection contacts 89 that cannot be moved elastically.

The USB 3.0 male connector has the structure and the associated dimensions substantially the same as those of the USB 2.0 male connector 90 except for the difference that the USB 3.0 additionally has one row of five connection contacts, which project from the socket space and can be moved elastically.

In either the conventional USB 2.0 or USB 3.0 female socket, only the simplex contact pattern is provided. In use, the male connector cannot be bidirectionally inserted into the female socket for electrical connection. For the sake of the convenience in use, it is preferred that the male connector can be bidirectionally inserted into the female socket for electrical connection.

SUMMARY OF THE INVENTION

It is therefore an object of the invention to provide a duplex male electrical connector with a socket shell and a connection board that can vertically float in a connection slot so that the duplex male electrical connector can be bidirectionally inserted into a female socket to achieve the duplex connection effect.

Another object of the invention is to provide a duplex male electrical connector with a socket shell, wherein a rear stopper block and connection terminals mounted on the rear stopper block are disposed on a rear end of the socket shell to provide the standard specification of the duplex male electrical connector.

To achieve the above-identified objects, the invention provides a duplex male electrical connector including an insulating base, two rows of first connection contacts and a socket shell. The insulating base has a front section formed with a connection board. The connection board has opposite top and bottom surfaces. The two rows of first connection contacts are disposed on the top and bottom surfaces of the connection board, respectively. The socket shell is formed with a connection slot having a front end serving as an insert port. The connection board is disposed in the connection slot. The socket shell and the connection board can vertically float and move relative to each other, such that the connection board can vertically float and move relative to the socket shell or the socket shell can vertically float and move relative to the connection board.

In the duplex male electrical connector with the socket shell, the rear stopper block is tightly plugged into the rear end of the socket shell, and the connection terminals are fixed to the rear stopper block. The connection terminal has a contact, a fixing portion and a pin. The fixing portion is fixed to the rear stopper block, the contact extends out of and in front of the rear stopper block, and the pin extends out of and in back of the rear stopper block. The two rows of first connection contacts are contacts electrically connected to the connection terminals.

According to the above-mentioned structure, the connection board can vertically float in the connection slot to achieve the duplex connection effect with the female socket. In addition, the rear stopper block and the connection terminals mounted in the rear stopper block are disposed on the rear end of the socket shell to provide the standard specification of the duplex male electrical connector.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

Figure 1:
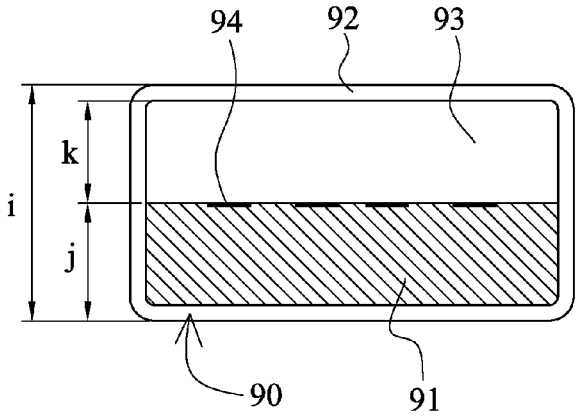
FIG. 1 (Prior Art)
FIG. 1 is a cross-sectional front view showing a conventional USB 2.0 male connector.
Figure 1A:
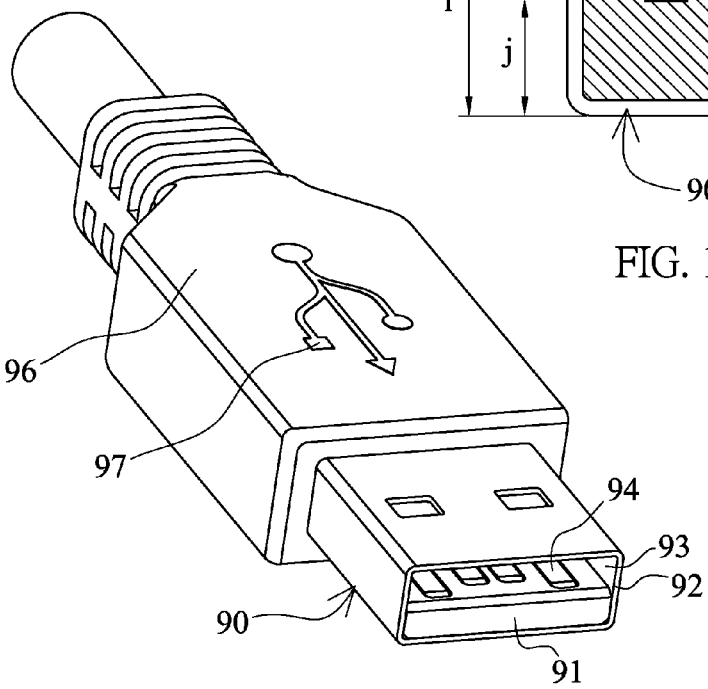
FIG. 1A (Prior Art)
FIG. 1A is a pictorial view showing the conventional USB 2.0 male connector, which is forwardly inserted and tilted downwards.
Figure 1B:
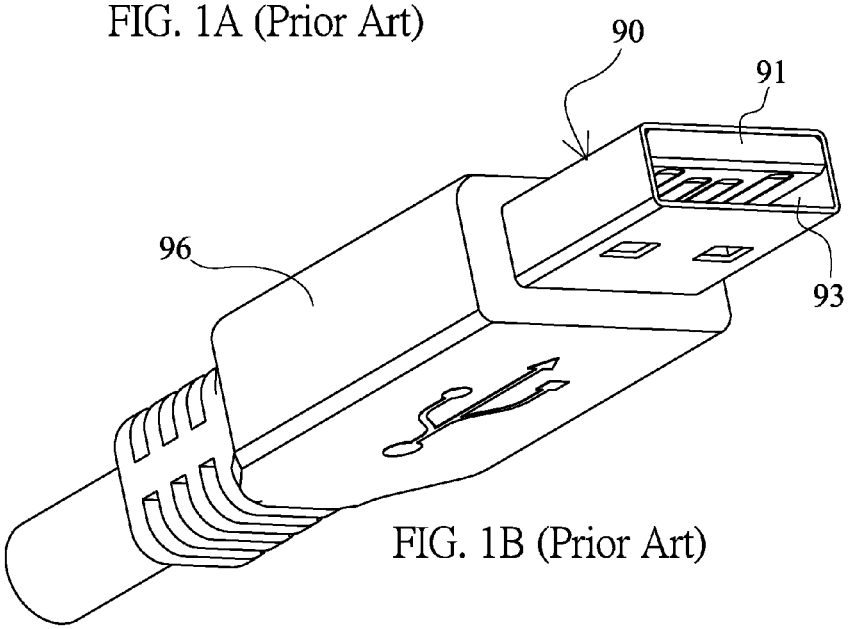
FIG. 1B (Prior Art)
FIG. 1B is a pictorial view showing the conventional USB 2.0 male connector, which is reversely inserted and tilted upwards.

The present invention will be apparent from the following detailed description, which proceeds with reference to the accompanying drawings, wherein the same references relate to the same elements.

Referring to FIGS. 3 to 9, a duplex-electrical-connection mobile disk (also referred to as a flash disk or a flash drive) with the USB 3.0 specification according to the first embodiment of the invention can be forwardly and reversely inserted into a female socket for electrical connection and includes an insulating base 30, two rows of second terminals 50, a socket shell 60, a position restricting structure 65, a returning structure 70, an electronic unit 78 and an external casing 75.

Figure 8:
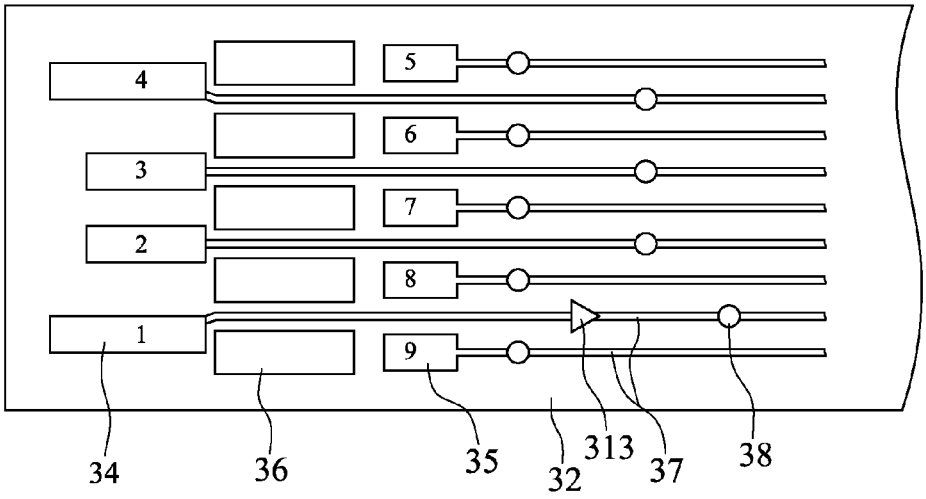
FIG. 8 is a schematic illustration showing cascaded circuits on a top surface of a printed circuit board according to the first embodiment of the invention.
Figure 9:
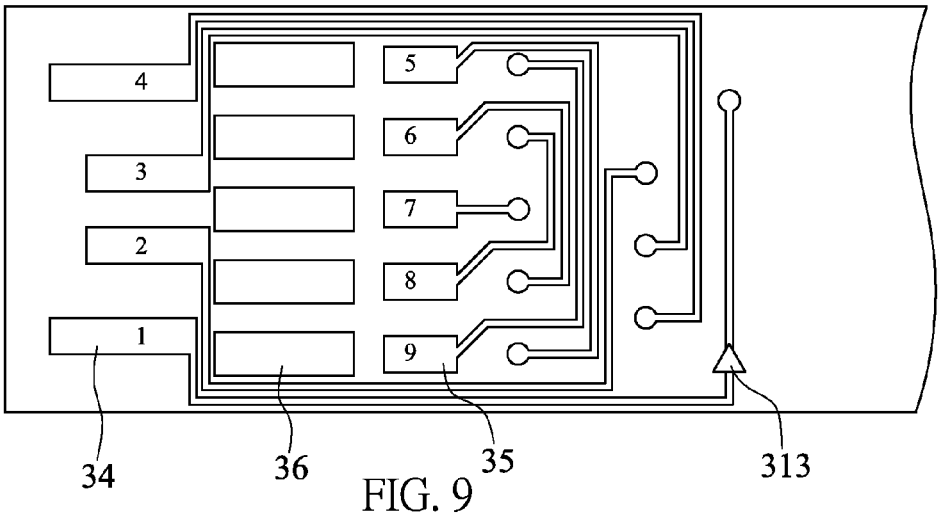
FIG. 9 is a schematic illustration showing cascaded circuits on a bottom surface of the printed circuit board according to the first embodiment of the invention.

The insulating base 30 is made of a hard material and cannot be elastically moved and distorted. The insulating base 30 includes a plastic seat 31, which cannot be elastically moved and distorted, and a printed circuit board 32. The plastic seat 31 has upper and lower seats combined with top and bottom surfaces of the rear section of the printed circuit board 32. A chamber is formed between the rear section of the printed circuit board 32 and the plastic seat 31 so that electronic elements can be advantageously placed on the top and bottom surfaces of the printed circuit board 32. The printed circuit board 32 has a front section projecting from the plastic seat 31 to form a connection board 33, and one row of four first connection contacts 34 are disposed on each of the top and bottom surfaces of the connection board 33. The two rows of first connection contacts 34 are circuit connection contacts of the printed circuit board, and may be golden fingers. The front end of the connection board 33 is formed with upper and lower inclined guiding surfaces 39 so that the connection board 33 is tapered. As shown in FIGS. 8 and 9, the connection board 33 is formed with one row of five through slots 36 in back of the first connection contacts 34, and one row of five bonding pads 35 corresponding to the one row of five through slots 36 are disposed on each of the top and bottom surfaces of the rear section of the connection board 33. The one row of bonding pads 35 are one row of electroconductive portions. Each of the first connection contact 34 and the bonding pad 35 is connected to a trace 37.

Figure 6A:
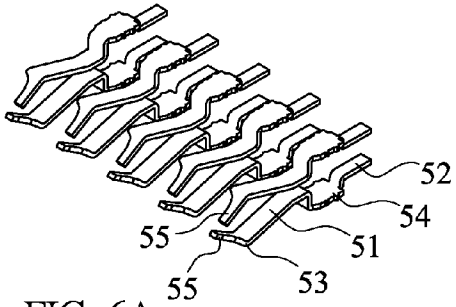
FIG. 6A is a pictorial view showing the arrangement of two rows of second terminals according to the first embodiment of the invention.
Figure 6:
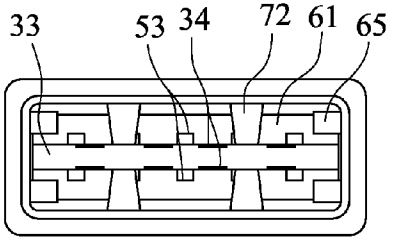
FIG. 6 is a front view showing the first embodiment of the invention.
Figure 7:
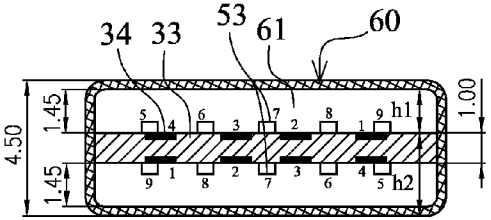
FIG. 7 is a front view showing a connection board and a connection slot according to the first embodiment of the invention.

Each of the two rows of second terminals 50 contain five terminals. The second terminal has an extension 51, a fixing portion 54 and a pin 52 from one end to the other end. The extension 51 can be elastically vertically moved and has a projecting second connection contact 53. The two rows of second terminals 50 are firstly assembled with and fixed to the upper and lower seats of the plastic seat 31 through the fixing portions 54. Then, the upper and lower seats of the plastic seat 31 are combined with the rear section of the printed circuit board 32. The pins 52 of the two rows of second terminals 50 are bonded to the two rows of bonding pads 35, the two rows of second connection contacts 53 respectively project from the top and bottom surfaces of the connection board 33 and can be elastically moved vertically in the through slot 36. The second connection contact 53 is disposed in back of the first connection contact 34. As shown in FIG. 6A, inclined guiding surfaces 55 with narrower plate surfaces are disposed on front ends of each of the second connection contacts 53 of the two rows of second terminals 50. The second connection contacts 53 of the two rows of second terminals 50 correspond to each other vertically or in a top-to-bottom manner. The inclined guiding surfaces 55 of the two rows of second terminals 50 are staggered horizontally in a left-to-right manner, so that the two rows of second terminals 50 cannot touch each other when they are elastically moved vertically. The one row of first connection contacts 34 and the one row of second connection contacts 53 form the USB 3.0 contact interface. As shown in FIGS. 7 to 9, the trace serial numbers of the two rows of first connection contacts 34 are arranged reversely, the trace serial numbers of the two rows of second connection contacts 53 are arranged reversely, the same trace serial numbers of the two rows of first connection contacts 34 are electrically connected together to form a cascaded set through electroconductive through holes 38, and the trace serial numbers of the two rows of second connection contacts 53 are electrically connected together to form another cascaded set through the electroconductive through holes 38. In addition, in the two rows of first connection contacts 34, the trace serial number 1 represents the power trace (VBUS), the trace serial number 2 (D−) and the trace serial number 3 (D+) represent a pair of signal traces, and the trace serial number 4 (GND) represents the grounding trace. In the two rows of second connection contacts 53, the trace serial number 5 (RX−) and the trace serial number 6 (RX+) represent a pair of signal traces, the trace serial number 8 (TX−) and the trace serial number 9 (TX+) represent the other pair of signal traces, and the trace serial number 7 (GND) represents the grounding trace. The trace serial numbers 1 of the two rows of first connection contacts 34 are the power traces and cannot be short-circuited. So, a Schottky diode 313 is electrically connected between the trace serial numbers 1 to mainly prevent the countercurrent so that the anti-short-circuit effect can be achieved.

The anti-short-circuit design using the Schottky diode is only one way of circuit security protection for electronically preventing the countercurrent or the short-circuited condition. However, there are many ways of circuit security protection, such as disposing the electronic element for preventing the countercurrent, the anti-short-circuit electronic element, the circuit security protection element or security circuit disposing means, for achieving the circuit security protection effect.

The socket shell 60 is made of a metal material covering the insulating base 30. A connection slot 61 is formed in the socket shell 60, and a front end of the connection slot 61 is an insert port. The connection board 33 is disposed in the connection slot. A vertical floating gap is formed between the insulating base 30 and the socket shell 60. The overall insulating base from the front end to the rear end can vertically float and move relative to the socket shell, such that the socket shell 60 and the connection board 33 can vertically float and move relative to each other.

Figure 7A:
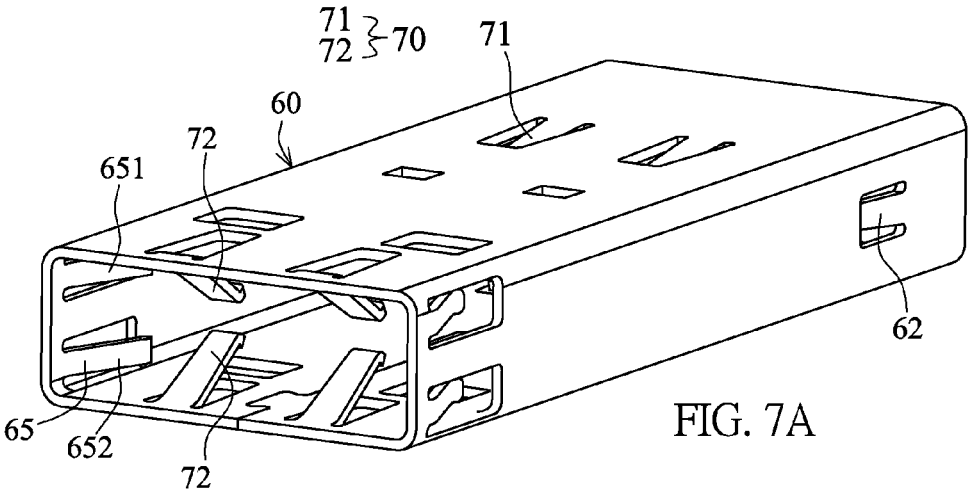
FIG. 7A is a pictorial view showing a socket shell according to the first embodiment of the invention.

The insulating base 30 is assembled with the socket shell 60 from rear to front. An anti-retrogression structure is disposed between the socket shell 60 and the insulating base 30 so that the retrogression of the insulating base 30 assembled with the socket shell 60 can be avoided. The anti-retrogression structure includes an elastic inverse hook 62 (see FIG. 7A) disposed on each of two sides of the rear section of the socket shell 60, and an engagement hole 311 (see FIG. 4) disposed on each of two sides of the rear section of the plastic seat 31 of the insulating base 30. The elastic inverse hook 62 hooks the engagement hole 311 to prevent the retrogression. In addition, a flange 310 (see FIG. 5) is disposed on each of two sides of the rear end of the plastic seat 31 of the insulating base 30. The flange 310 rests against the socket shell 60 to achieve the positioning.

Figure 10:
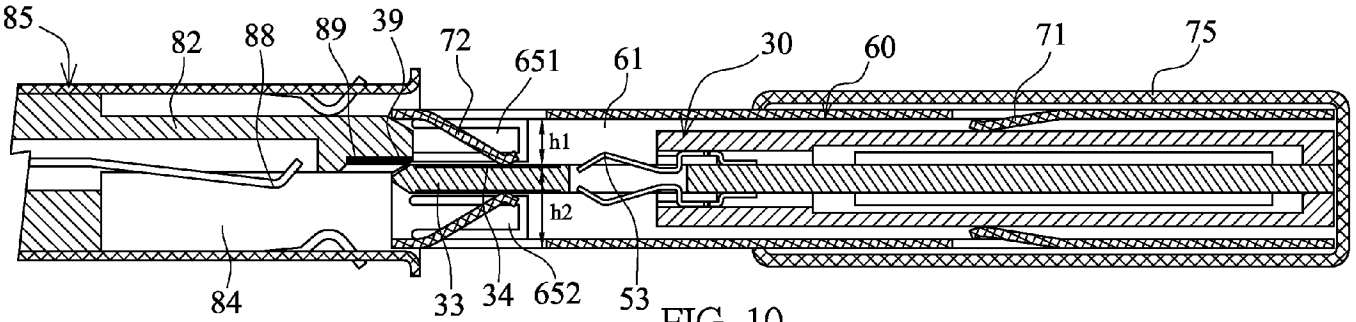
FIG. 10 shows the used state according to the first embodiment of the invention.
Figure 11:
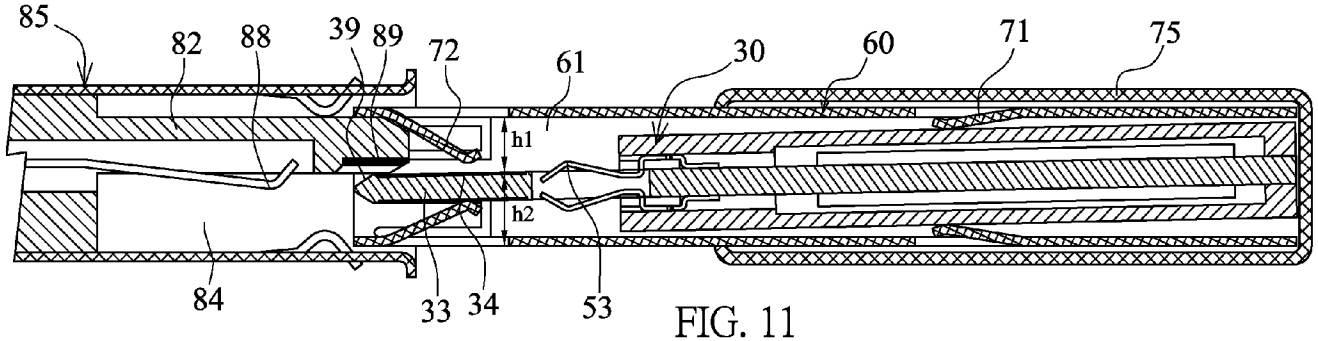
FIG. 11 shows the used state according to the first embodiment of the invention.
Figure 12:
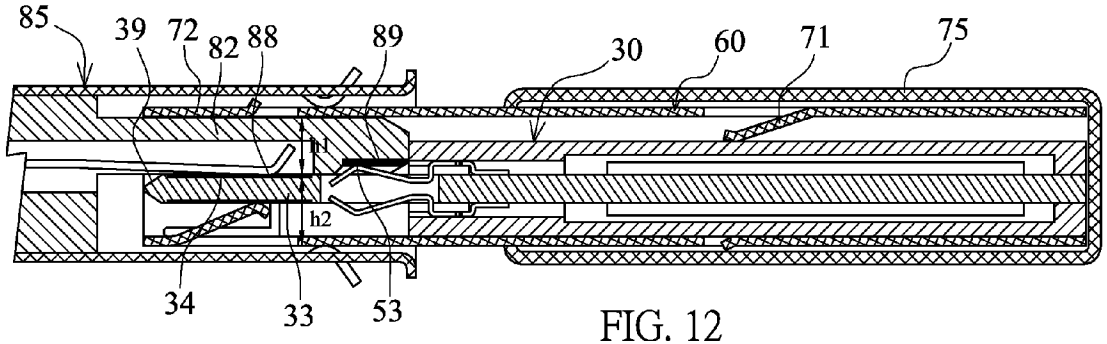
FIG. 12 shows the used state according to the first embodiment of the invention.

The position restricting structure 65 restricts the up and down movable positions of the connection board 33 relative to the socket shell 60 by restricting the connection board 33 at a position within a middle section of a height of the socket shell 60 with the connection board 33 being separated from the socket shell 60 (see FIGS. 10 to 12). The position restricting structure has two pairs of upper and lower position restricting sheets 651 and 652, which are integrally connected to two side surfaces of the socket shell 60 and project toward the connection slot 61. Each pair of upper and lower position restricting sheets 651 and 652 have a height difference (or step). The connection board 33 is disposed between each pair of upper and lower position restricting sheets 651 and 652. The height difference corresponds to the movable region of the connection board 33. The upper and lower position restricting sheets 651 and 652 are prodded and project from two side surfaces of the socket shell 60 and inwardly and forwardly integrally extend from the insert port of the connection slot to the distal ends and to be open. The two side surfaces of the socket shell 60 are formed with openings. The upper and lower position restricting sheets 651 and 652 can be elastically moved laterally. The upper and lower position restricting sheets 651 and 652 are separated from the top and bottom surfaces of the socket shell 60 by gaps, respectively. The upper and lower position restricting sheets 651 and 652 vertically elastically moved can rest against the top and bottom surfaces of the socket shell 60, and the gaps correspond to the vertically floating tolerance of the connection board relative to the socket shell.

The returning structure 70 includes many elastic returning sheets 71 and 72, which are integrally connected to the top surface and the bottom surface of the socket shell 60 and project toward the connection slot, and can be vertically elastically moved. The elastic returning sheets 71 symmetrically press the top and bottom surfaces of the plastic seat 31 of the rear section of the insulating base 30. The elastic returning sheets 72 symmetrically press the top and bottom surfaces of the connection board 33. The elastic returning sheet 72 rests between two first connection contacts 34 and does not contact with the first connection contact 34. The elastic returning sheets 71 and 72 are prodded and project from the top and bottom surfaces of the socket shell 60. The elastic returning sheet 72 inwardly and forwardly integrally extends from the insert port of the connection slot 61 to the distal end and to be open. The top and bottom surfaces of the socket shell 60 are formed with openings. The returning structure 70 returns the connection board 33 to the middle position of the height of the connection slot 61.

The electronic unit 78 is a storage unit, which is electrically connected to the printed circuit board 32 and includes a memory and a control circuit. The capacity of the memory is not restricted. The control circuit controls the operation of the memory of the electronic unit. The two rows of first connection contacts 34 and the two rows of second connection contacts 53 are electrically connected to the electronic unit 78.

The external casing 75 is made of a plastic material and covers the rear section of the socket shell 60 and the rear section of the insulating base 30. The external casing 75 and the socket shell 60 are in the form of fixed engagement. The socket shell 60 has engagement holes 622. The front end of the external casing 75 is formed with hooks 76 hooking the engagement holes 622, so that the external casing 75 and the socket shell 60 are fixed together, and the connection board 33 can vertically float and move relative to the socket shell 60.

Figure 2:
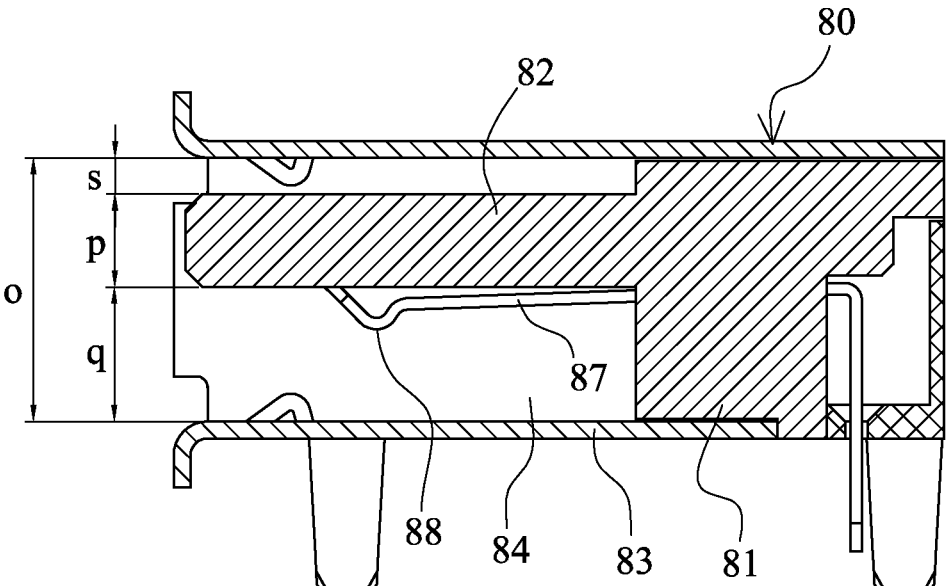
FIG. 2 (Prior Art)
FIG. 2 is a cross-sectional side view showing a conventional USB 2.0 female socket.
Figure 2A:
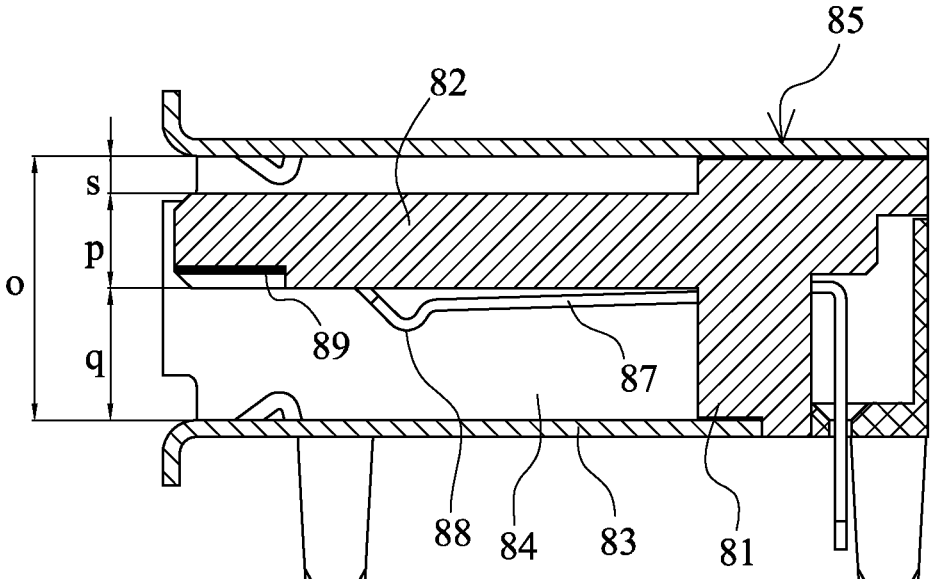
FIG. 2A (Prior Art)
FIG. 2A is a cross-sectional side view showing a conventional USB 3.0 female socket.
Figure 5:
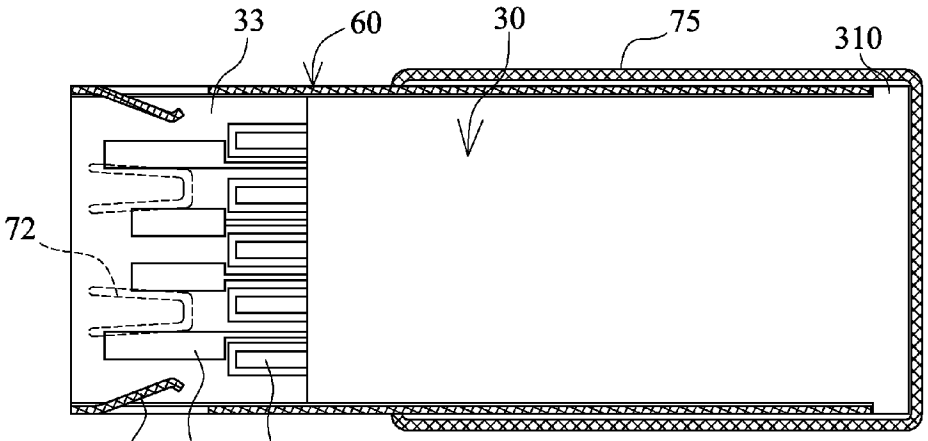
FIG. 5 is a cross-sectional top view showing the first embodiment of the invention.
Figure 3:
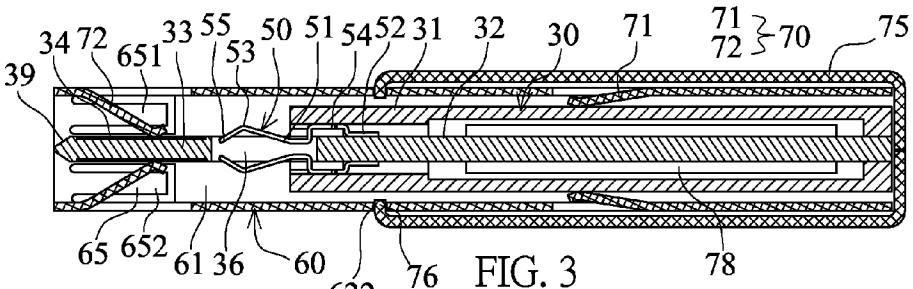
FIG. 3 is a cross-sectional side view showing a first embodiment of the invention.
Figure 4:
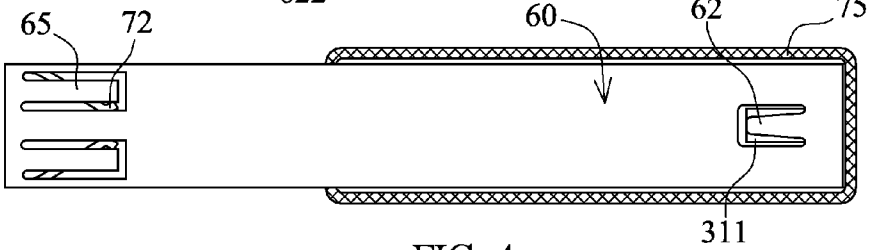
FIG. 4 is a cross-sectional side view showing the first embodiment of the invention.

As shown in FIG. 7, the socket shell 60 has the height ranging from 4.3 mm to 5.0 mm, and preferably from 4.4 mm to 4.6 mm; and the connection board 33 has the thickness ranging from 0.5 mm to 1.6 mm, and preferably from 0.8 mm to 1.mm. In this example embodiment, the height of the socket shell 60 is 4.5 mm, the thickness of the connection board 33 is 1 mm, and the material thickness of the socket shell 60 is 0.3 mm. Thus, the space height h1 above the connection board 33 is 1.45 mm, and the summation height h2 of the space height below the connection board and the material thickness is 2.75 mm. Therefore, when the insertion is performed in conjunction with the USB 3.0 female socket 85 of FIG. 2A, h1 is 1.45 mm, which is smaller than the thickness p (1.84 mm) of the tongue 82, and h2 is 2.75 mm, which is greater than the height q (2.56 mm) below the tongue. So, if the connection board 33 cannot vertically float and move in the connection slot 61, the mobile disk cannot be inserted into the USB 3.0 female socket 85.

As shown in FIG. 10, when the mobile disk of this embodiment with the above-mentioned structure is inserted into the USB 3.0 female socket 85, the space height h1 above the connection board 33 is 1.45 mm, which is larger than the thickness (1.84 mm) of the tongue 82. So, the front end of the connection board 33 touches the tongue 82. As shown in FIG. 11, the upper and lower inclined guiding surfaces 39 on the front end can guide the connection board 33 into the connection slot 84, so that the connection board 33 moves downwards in the connection slot 61. At this time, h1 is increased and h2 is decreased. As shown in FIG. 12, when the connection board 33 is inserted to be positioned, the tongue 82 pushes the upper position restricting sheet 651 toward one side so that the space above the connection board 33 is entirely released to fit with the tongue 82. The connection board 33 in the connection slot 61 moves down by about 0.5 mm and is restricted by the lower position restricting sheet 652. At this time, h1 is 1.95 mm and h2 is 2.25 mm. This completely satisfies the specifications specified by the USB association, and the reliable electrical connection of the connection board 33 restricted by the lower position restricting sheet 652 can be ensured.

The structure feature of this embodiment will be described in the following. When the male plug is inserted into the female socket and when the tongue 82 pushes the upper position restricting sheet 651 toward one side, the lower position restricting sheet 652 can restrict and rest against the connection board 33 to ensure the reliable electrical connection. In the reverse condition, when the tongue 82 pushes the lower position restricting sheet 652 toward one side, the upper position restricting sheet 651 can restrict and rest against the connection board 33 to ensure the reliable electrical connection.

In addition, the overall insulating base 30 of this embodiment from the front end to the rear end and the socket shell can vertically float and move relative to each other, so that the connection board 33 can vertically float and move relative to the socket shell.

According to the above-mentioned structure, this embodiment has the following effects.

1. The male connector can be plugged into the USB 3.0 female socket 85 bidirectionally or in a duplex manner according to the connection board 33, which can vertically float and move in the connection slot 61.

2. The returning structure 70 returns the connection board 33 to the middle position of the height of the connection slot 61.

3. The reliable electrical connection of the connection board 33 can be ensured by the restriction and resting of the position restricting structure 65.

In the above-mentioned embodiment, the electronic unit 78 may also be a wireless transceiving unit to form a wireless transceiver, or another application unit to form another electronic device.

Figure 13:
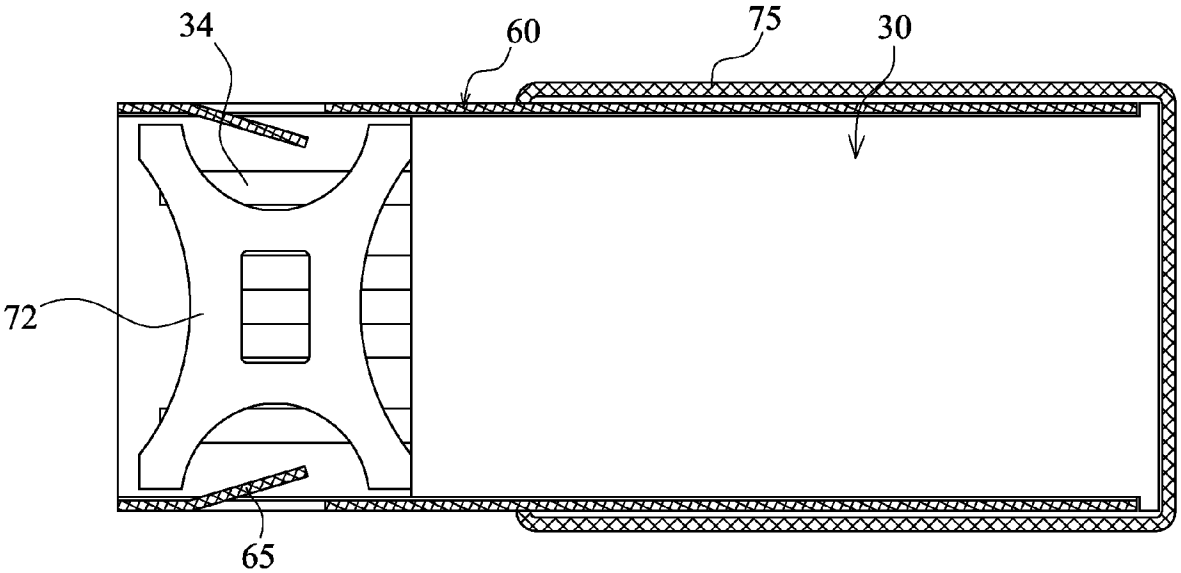
FIG. 13 is a cross-sectional top view showing a second embodiment of the invention.
Figure 14:
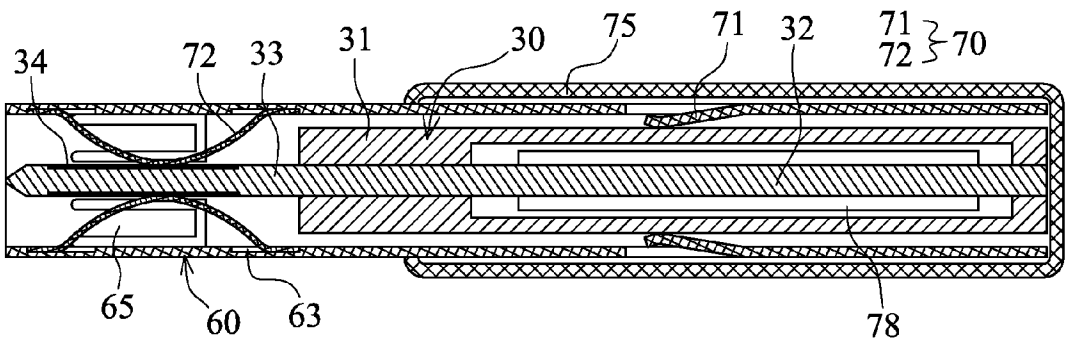
FIG. 14 is a cross-sectional side view showing the second embodiment of the invention.
Figure 15:
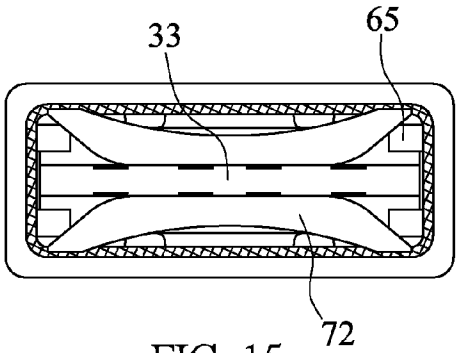
FIG. 15 is a front-side cross-sectional view showing the second embodiment of the invention.

Referring to FIGS. 13 to 15, a duplex electrical-connection mobile disk with the USB 2.0 specification according to the second embodiment of the invention includes an insulating base 30, a socket shell 60, a position restricting structure 65, a returning structure 70, an electronic unit 78 and an external casing 75, and is substantially the same as the first embodiment except that the two elastic returning sheets 72 of the returning structure 70 of this embodiment resting against the connection board 33 form the substantial X-shape, and the two elastic returning sheets 72 and the socket shell 60 are disposed separately. The top and bottom surfaces of the socket shell 60 are formed with cavities 63 engaging with the two elastic returning sheets 72.

Figure 16:
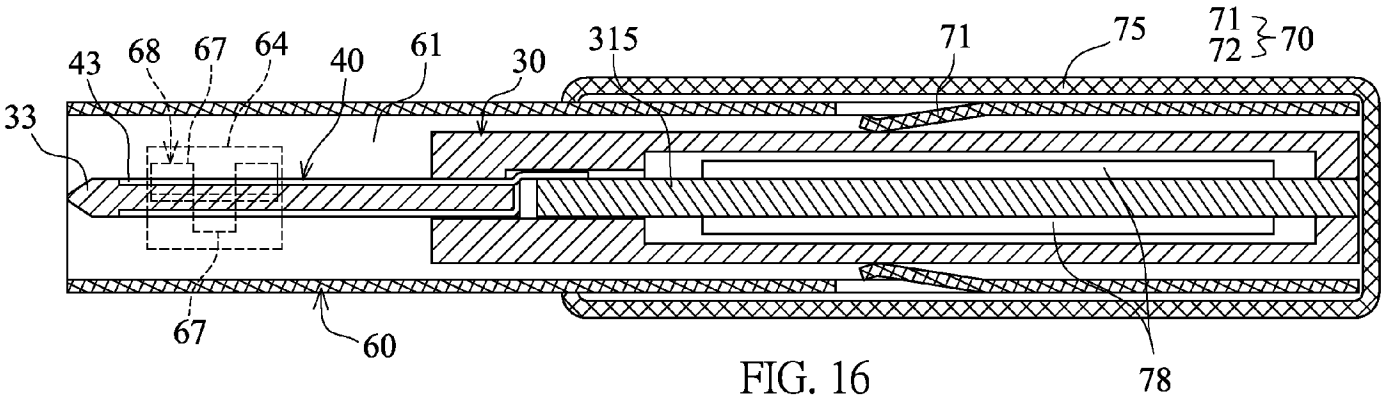
FIG. 16 is a cross-sectional side view showing a third embodiment of the invention.
Figure 18:
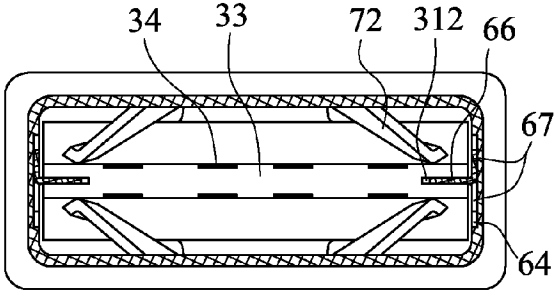
FIG. 18 is a front-side cross-sectional view showing the third embodiment of the invention.
Figure 17:
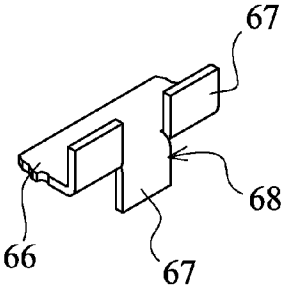
FIG. 17 is a pictorial view showing a positioning sheet according to the third embodiment of the invention.

Referring to FIGS. 16 to 18, a duplex electrical-connection mobile disk with the USB 2.0 specification according to the third embodiment of the invention includes an insulating base 30, two rows of first terminals 40, a socket shell 60, a position restricting structure, a returning structure 70, an electronic unit 78 and an external casing 75, wherein the elastic returning sheet 72 is not shown in FIG. 16 for the clearness of the drawing. The mobile disk of this embodiment is substantially the same as that of the first embodiment except that the insulating base 30 is a plastic seat and has a front end integrally formed jointly with the connection board 33, and that a printed circuit board 315 is disposed in the insulating base 30.

The two rows of first terminals 40 are formed by pressing a metal sheet, and are disposed in the insulating base 30 and electrically connected to the printed circuit board 315. The first terminal 40 has a first connection contact 43, and the first connection contacts 43 of the two rows of first terminals 40 are in flat surface contact with the top and bottom surfaces of the connection board 33, respectively.

The position restricting structure includes two movable slots 64 and two positioning boards 68. The two movable slots 64 are disposed on inner surfaces of two sides of the socket shell 60. The positioning board 68 does not move elastically and has a horizontal board 66, two vertical boards 67 extending upwards and one vertical board extending downwards. The horizontal board 66 is engaged with the slot 312 of one side of the connection board 33. A vertical gap still exists after the vertical board 67 is engaged into the movable slot 64, so that the vertical board 67 vertically floats and is vertically restricted by the movable slot 64. The elastic returning sheets 72 of the returning structure 70 slantingly rests against two sides of the top and bottom surfaces of the connection board 33 from the inside to the outside so that they cannot contact with the first connection contact 34.

According to the above-mentioned structure, when the connection board 33 vertically floats and moves in the connection slot 61, the vertical boards 67 of the positioning board 68 may be restricted by and rest against top and bottom ends of the movable slot 64.

Figure 19:
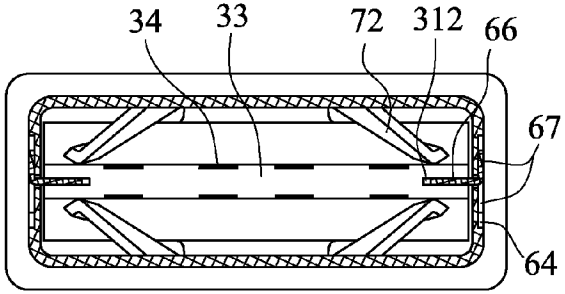
FIG. 19 is a front-side cross-sectional view showing a fourth embodiment of the invention.

As shown in FIG. 19, the fourth embodiment of the invention is substantially the same as the third embodiment except for the difference that the movable slots 64 of this embodiment are disposed outside two sides of the socket shell 60.

Figure 20:
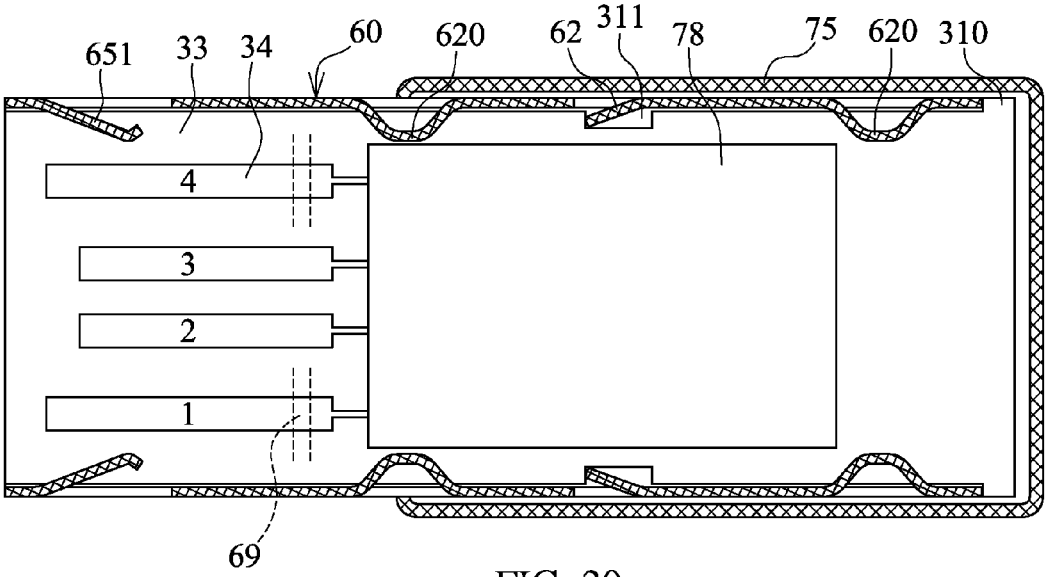
FIG. 20 is a cross-sectional top view showing a fifth embodiment of the invention.
Figure 20A:
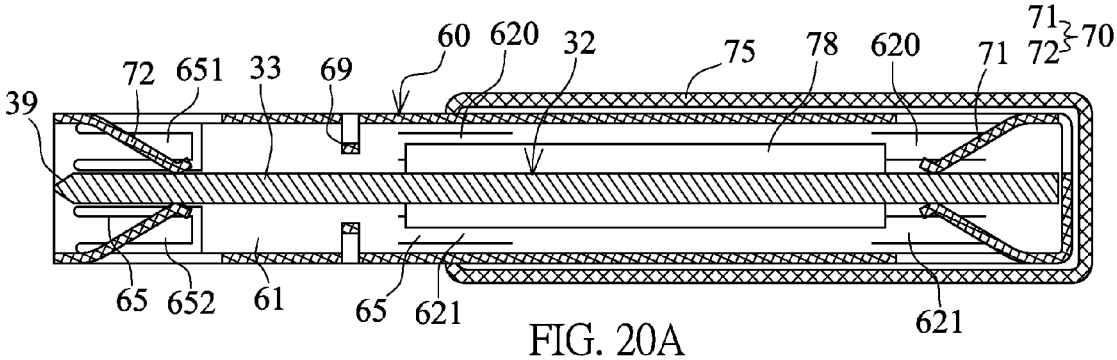
FIG. 20A is a cross-sectional side view showing the fifth embodiment of the invention.

Referring to FIGS. 20 and 20A, a duplex electrical-connection mobile disk with the USB 2.0 specification according to the fifth embodiment of the invention includes an insulating base, a socket shell 60, a position restricting structure 65, a returning structure 70, an electronic unit 78 and an external casing 75.

The overall insulating base is a printed circuit board 32. The top and bottom surfaces of the rear section of the printed circuit board 32 is not combined with a plastic seat. Larger spaces are left between the top and bottom surfaces of the printed circuit board 32 and the socket shell 60, and this is advantageous to the arrangement of the electronic elements. The front section of the printed circuit board 32 is a connection board 33. One row of four first connection contacts 34 are disposed on each of the top and bottom surfaces of the connection board 33. The two rows of first connection contacts 34 are circuit connection contacts of the printed circuit board, and may be golden fingers. The front end of the connection board 33 is formed with upper and lower inclined guiding surfaces 39 and is tapered. The two rows of first connection contacts 34 pertain to the USB 2.0 interface. The trace serial numbers of the two rows of first connection contacts 34 are arranged reversely, and the same trace serial numbers are electrically connected together to form a cascaded set through the electroconductive through holes, wherein the two rows of first connection contacts 34 are disposed in a manner similar to that of the first embodiment.

The socket shell 60 is made of a metal material and covers the printed circuit board 32. The socket shell 60 is formed with a connection slot 61 and has a front end serving as an insert port. The connection board 33 is disposed in the connection slot 61. A vertical floating gap is formed between the printed circuit board 32 and the socket shell 60, so that the socket shell 60 and the connection board 33 can vertically float and move relative to each other. In addition, stopper blocks 69 are disposed in the socket shell 60 and serve as rear end stopper surfaces of the connection slot 61. The stopper blocks 69 are prodded and project from the top and bottom surfaces of the socket shell 60 to the connection slot to from projections.

The printed circuit board 32 is assembled with the socket shell 60 from rear to front. An anti-retrogression structure is disposed between the printed circuit board 32 and the socket shell 60, so that the printed circuit board 32 assembled with the socket shell 60 can avoid the retrogression. The anti-retrogression structure includes an elastic inverse hook 62 disposed on each of two sides of the rear section of the socket shell 60, and an engagement hole 311 disposed on each of two sides of the rear section of the printed circuit board 32. The elastic inverse hook 62 hooks the engagement hole 311 to avoid the retrogression. In addition, a flange 310 is disposed on each of two sides of the rear end of the printed circuit board 32, and the flange 310 rests against the socket shell 60 to achieve the positioning effect.

The position restricting structure 65 restricts the up and down movable positions of the connection board 30 relative to the socket shell 60 by restricting an end section of the insulating base 30 at the position within the middle section of the height of the socket shell 60 with the connection board 33 being separated from the socket shell 60 (see FIGS. 20 and 20A). The position restricting structure 65 includes two pairs of upper and lower position restricting sheets 651 and 652, which are respectively integrally connected to the front sections of the two side surfaces of the socket shell 60 and project toward the connection slot 61, and four pairs of upper and lower position restricting sheets 620 and 621, which are respectively integrally connected to the rear sections of the two side surfaces of the socket shell 60 and project toward the connection slot 61. Each pair of upper and lower position restricting sheets 651 and 652 have a height difference (or step). Each pair of upper and lower position restricting sheets 620 and 621 have a height difference (or step). The height difference corresponds to the movable region of the printed circuit board 32. The upper and lower position restricting sheets 651 and 652 are prodded and project from the two side surfaces of the socket shell 60, and inwardly and forwardly integrally extend from the insert port of the connection slot to the distal ends and to be open. The two side surfaces of the socket shell 60 are formed with openings. The upper and lower position restricting sheets 651 and 652 can be laterally elastically moved. The upper and lower position restricting sheets 620 and 621 are convex portions formed by pressing the two side surfaces of the socket shell 60 inwards. The upper and lower position restricting sheets 620 and 621 are fixed and cannot be elastically moved.

The returning structure 70 and the electronic unit 78 are substantially the same as those of the first embodiment.

The external casing 75 is made of the plastic material and covers the rear section of the socket shell 60 and the printed circuit board 32. The external casing 75 and the socket shell 60 are fixed, so that the connection board 33 can vertically float and move relative to the socket shell 60.

The overall insulating base of this embodiment is a printed circuit board 32, the rear section of the printed circuit board 32 is not combined with and covered by the plastic material. Larger spaces are left between the top and bottom surfaces of the printed circuit board 32 and the socket shell 60, and this is advantageous to the arrangement of the electronic elements. Thus, it is advantageous to the design of the ultra-short electronic product. Furthermore, the structure simplification simplifies the manufacturing processes and decreases the material cost.

Figure 21:
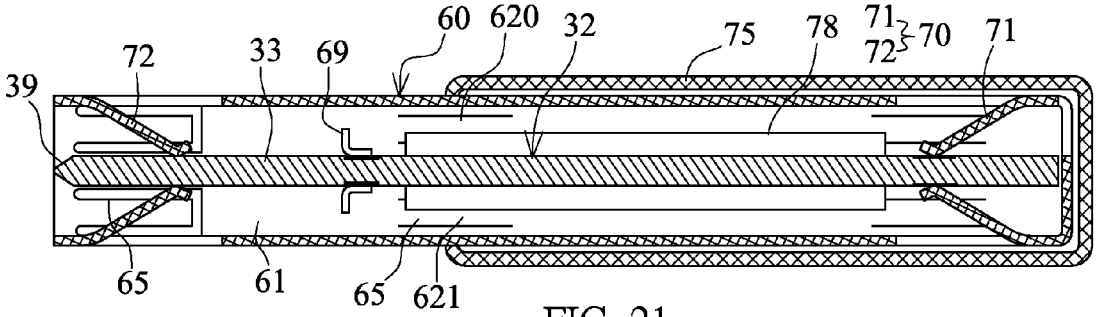
FIG. 21 is a cross-sectional side view showing a sixth embodiment of the invention.

Referring to FIG. 21, a duplex electrical-connection mobile disk with the USB 2.0 specification according to the sixth embodiment of the invention is substantially the same as the fifth embodiment except for the difference that the two stopper blocks 69 are L-shaped boards bonded to the top and bottom surfaces of the printed circuit board 32. The tail end of the elastic returning sheet 71 is bonded to the printed circuit board 32.

Figure 22:
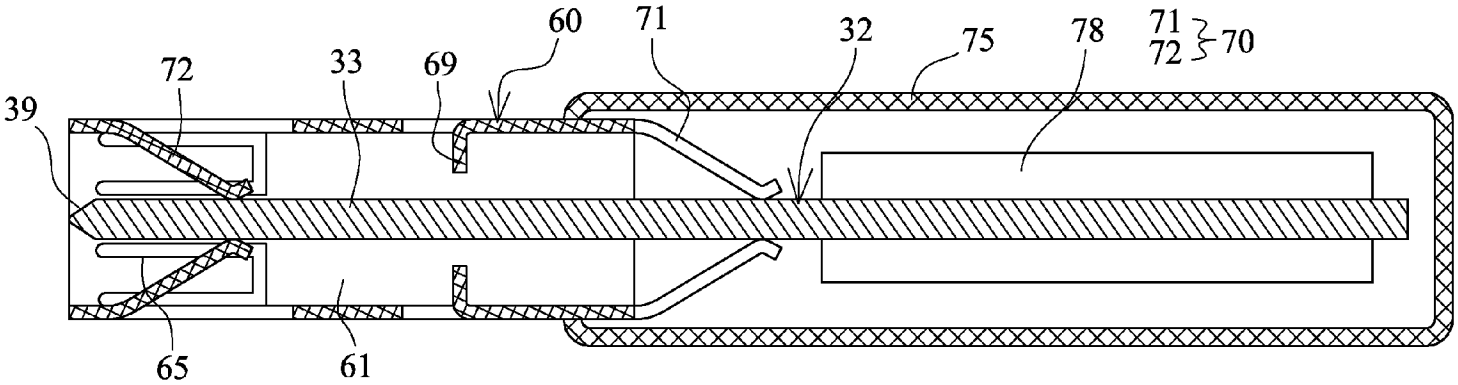
FIG. 22 is a cross-sectional side view showing a seventh embodiment of the invention.

As shown in FIG. 22, the seventh embodiment of the invention is substantially the same as the fifth embodiment except for the difference that the socket shell 60 is shorter. So, no fixed upper and lower position restricting sheets are provided, and the elastic returning sheet 71 is connected to the rear end of the socket shell 60 and extends backwards.

Figure 23:
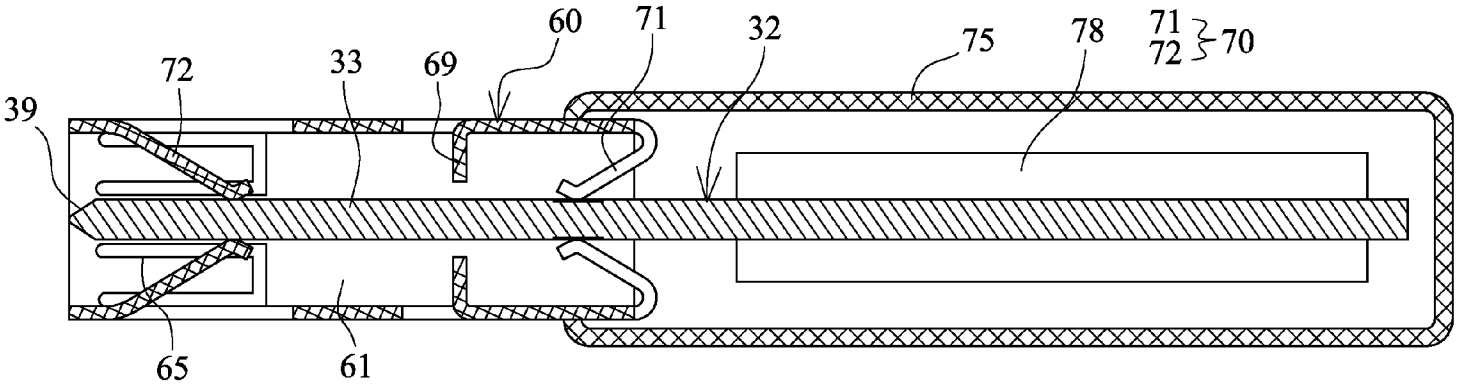
FIG. 23 is a cross-sectional side view showing an eighth embodiment of the invention.

As shown in FIG. 23, the eighth embodiment of the invention is substantially the same as the seventh embodiment except for the difference that the tail end of the elastic returning sheet 71 is reversely bent frontwards and bonded to the printed circuit board 32.

Figure 24:
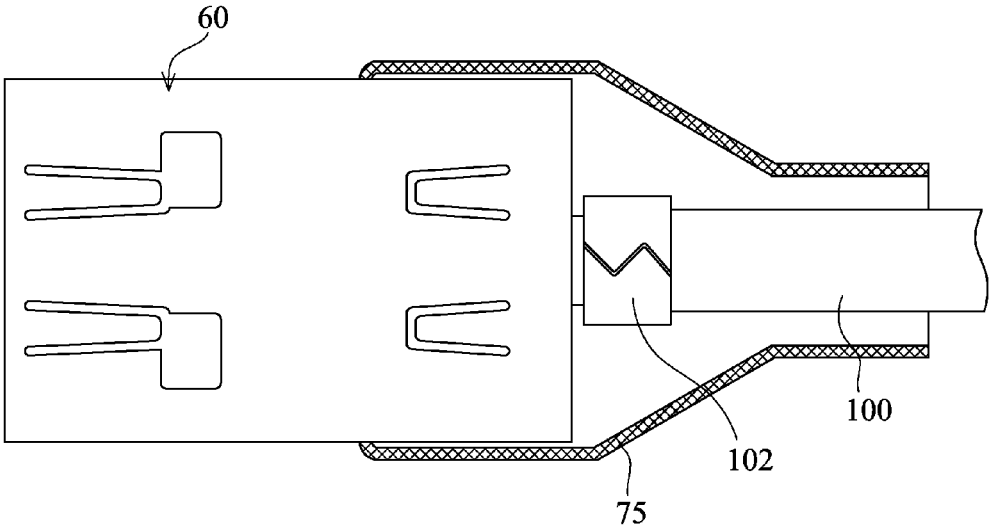
FIG. 24 is a cross-sectional top view showing a ninth embodiment of the invention.
Figure 25:
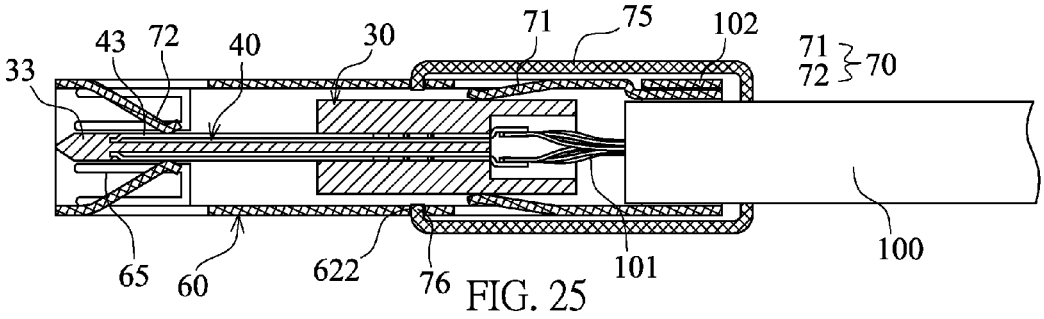
FIG. 25 is a cross-sectional side view showing the ninth embodiment of the invention.

As shown in FIGS. 24 and 25, the ninth embodiment of the invention is a duplex electrical-connection electric cable with the USB 2.0 specification and includes an insulating base 30, two rows of first terminals 40, a socket shell 60, a position restricting structure 65, a returning structure 70, an electronic unit and an external casing 75. The ninth embodiment is substantially the same as the first embodiment and the third embodiment except for the difference that the electronic unit of this embodiment is a connection cable 100, which has wires 101 electrically connected to two rows of first terminals 40. The connection cable 100 is fixed to the socket shell 60 through a wire clipper 102.

Figure 26:
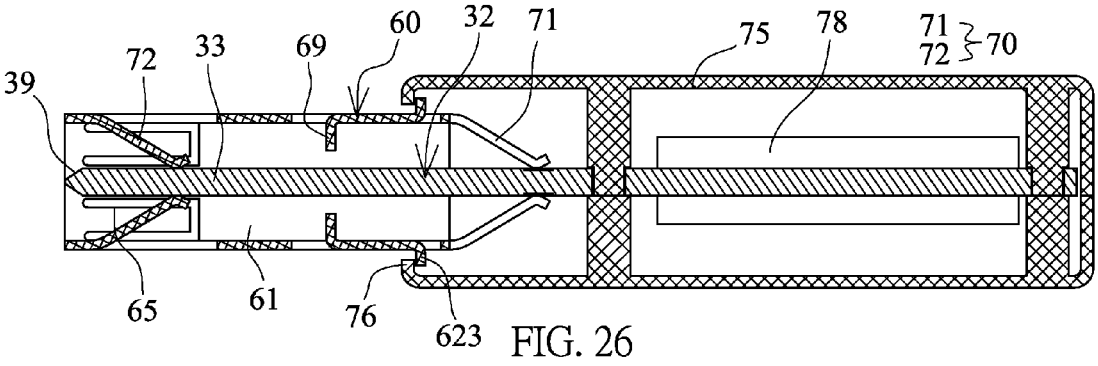
FIG. 26 is a cross-sectional side view showing a tenth embodiment of the invention.

As shown in FIG. 26, the tenth embodiment of the invention is substantially the same as the seventh embodiment except for the difference that the printed circuit board 32 is fixed to the external casing 75, the tail end of the elastic returning sheet 71 is bonded to the printed circuit board 32, the external casing 75 and the socket shell 60 detachably engage with each other, the socket shell 60 has vertical cards 623, and the front end of the external casing 75 has hooks 76 hooking the cards 623, so that the external casing 75 and the socket shell 60 are fixed in the front-to-rear direction and are movable in the vertical direction. Thus, the socket shell 60 can vertically float and move relative to the printed circuit board 32.

Figure 27:
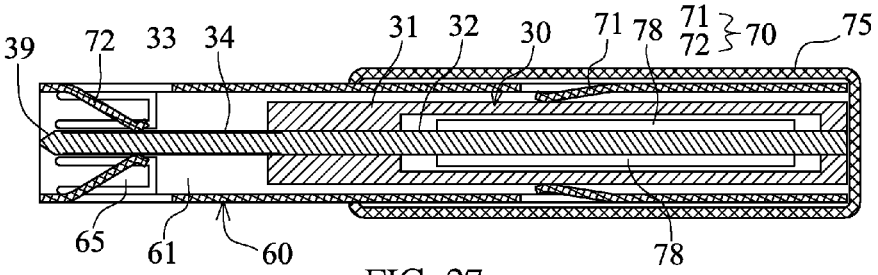
FIG. 27 is a cross-sectional side view showing an eleventh embodiment of the invention.

As shown in FIG. 27, the eleventh embodiment of the invention is substantially the same as the first embodiment except for the difference that only one row of first connection contacts 34 are disposed on each of the top and bottom surfaces of the connection board 33 of the insulating base 30 of this embodiment, and no second connection contact is disposed thereon. In addition, the two rows of first connection contacts are not cascaded and are in the form of the independent contact interfaces and in the form of the independent connection contacts. Each of the two rows of first connection contacts are individually electrically connected to an electronic unit 78.

Figure 28:
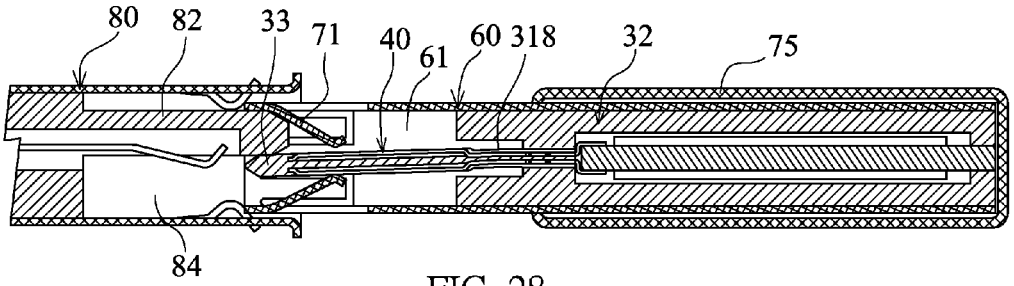
FIG. 28 is a cross-sectional side view showing a twelfth embodiment of the invention.
Figure 29:
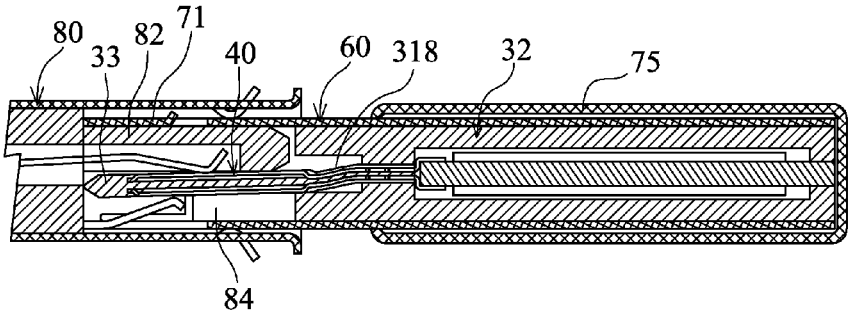
FIG. 29 shows a used state of the twelfth embodiment of the invention.

As shown in FIGS. 28 and 29, the twelfth embodiment of the invention is a duplex electrical-connection mobile disk with the USB 2.0 specification and is substantially the same as the first embodiment and the third embodiment except for the difference that a flexible twisting portion 318 is disposed between the connection board 33 and the insulating base 30 in this embodiment. When the mobile disk is inserted into the USB 2.0 female socket 80 for electrical connection, the twisting portion 318 is distorted to move the connection board 33 downwards in the connection slot 61.

Figure 30:
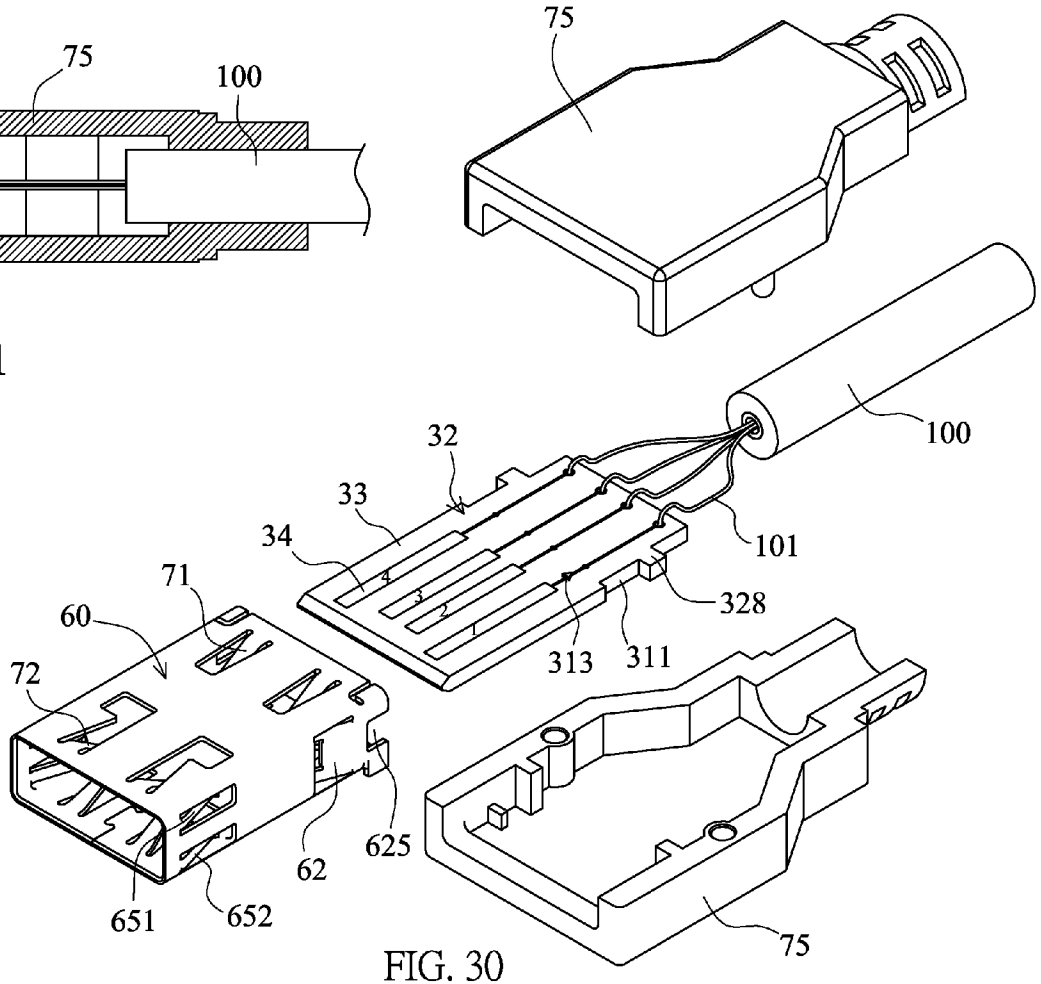
FIG. 30 is a pictorially exploded view showing a $13^{th}$ embodiment of the invention.
Figure 31:
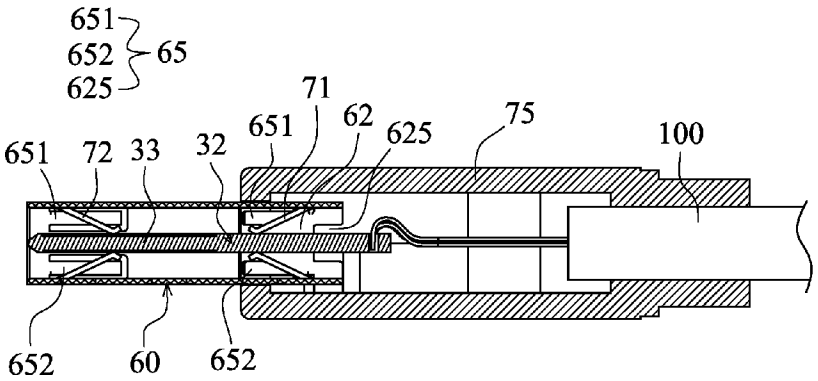
FIG. 31 is a cross-sectional side view showing the $13^{th}$ embodiment of the invention.

As shown in FIGS. 30 and 31, the 13$^{th}$ embodiment of the invention is a duplex electrical-connection electric cable with the USB 2.0 specification and is substantially the same as the fifth and ninth embodiments except for the difference that the position restricting structure 65 of this embodiment further includes four pairs of upper and lower position restricting sheets 651 and 652 and two position restricting holes 625, wherein the rear two pairs of upper and lower position restricting sheets 651 and 652 are integrally disposed on the two elastic inverse hooks 62. The two position restricting holes 625 are disposed on the two side surfaces of the rear end of the socket shell 60. Flanges 328 are disposed on two sides of the printed circuit board 32 and engage with the position restricting holes 625.

Figures 32, 33:
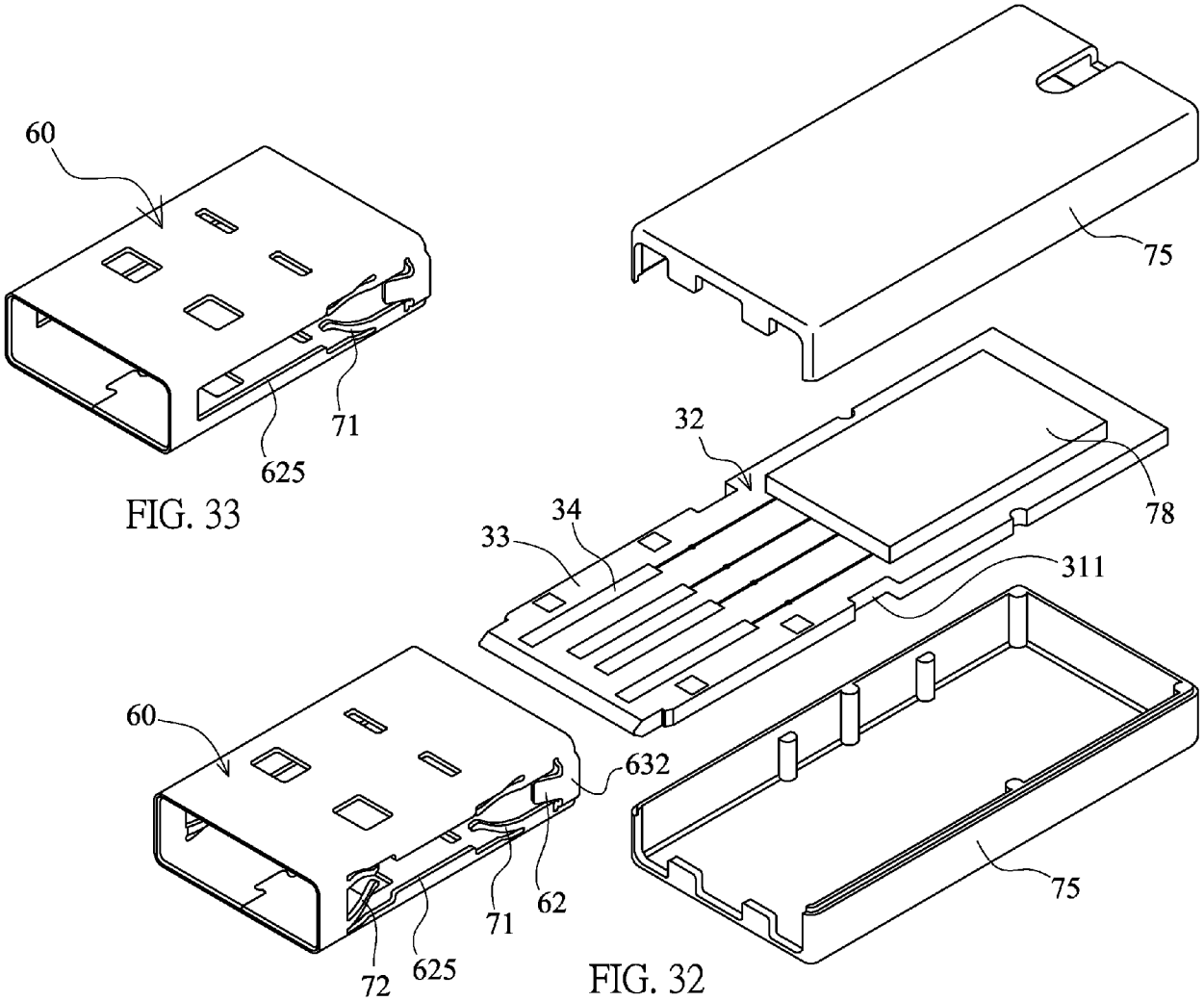
FIG. 32 is a pictorially exploded view showing a $14^{th}$ embodiment of the invention.
FIG. 33 is a pictorial view showing a socket shell according to a $15^{th}$ embodiment of the invention.

As shown in FIG. 32, the 14$^{th}$ embodiment of the invention is a duplex electrical-connection mobile disk with the USB 2.0 specification and is substantially the same as the fifth and 13$^{th}$ embodiments except for the difference that the elastic returning sheets 71 and 72 of the returning structure of this embodiment are paired and formed by pressing the two side surfaces of the socket shell 60, the elastic returning sheets 71 and 72 project toward the inside of the socket shell, the two pairs of elastic returning sheets 72 rest against two sides of the top and bottom surfaces of the connection board 33 on the front section of the printed circuit board, the two pairs of elastic returning sheets 71 rest against two sides of the top and bottom surfaces on the rear section of the printed circuit board, the position restricting structure only has position restricting holes 625 on the two side surfaces of the socket shell 60, and the two side surfaces of the rear end of the socket shell 60 have outward convex portions 632 to enhance the structural strength, wherein two sides of the rear section of the printed circuit board 32 can pass the convex portions 632 and engage with the position restricting holes 625.

As shown in FIG. 33, the 15$^{th}$ embodiment of the invention is substantially the same as the 14$^{th}$ embodiment except for the difference that the returning structure 70 of this embodiment only has a pair of elastic returning sheets 71 resting against two sides of the top and bottom surfaces on the rear section of the printed circuit board 32.

Figure 34:
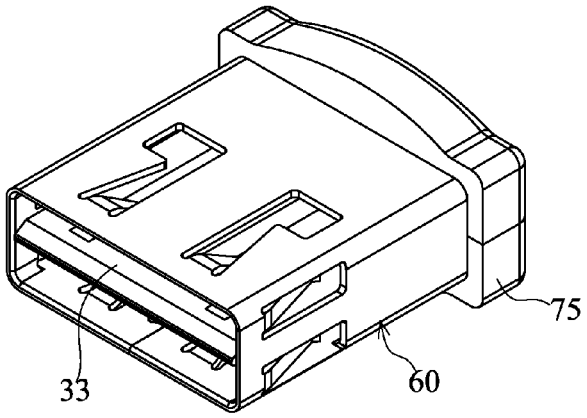
FIG. 34 is a pictorially assembled view showing a $16^{th}$ embodiment of the invention.
Figure 36:
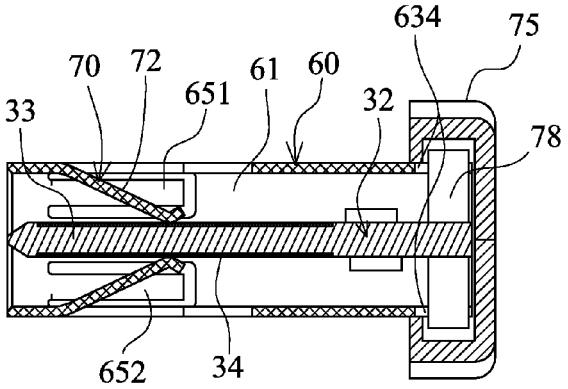
FIG. 36 is a cross-sectional side view showing the $16^{th}$ embodiment of the invention.
Figure 35:
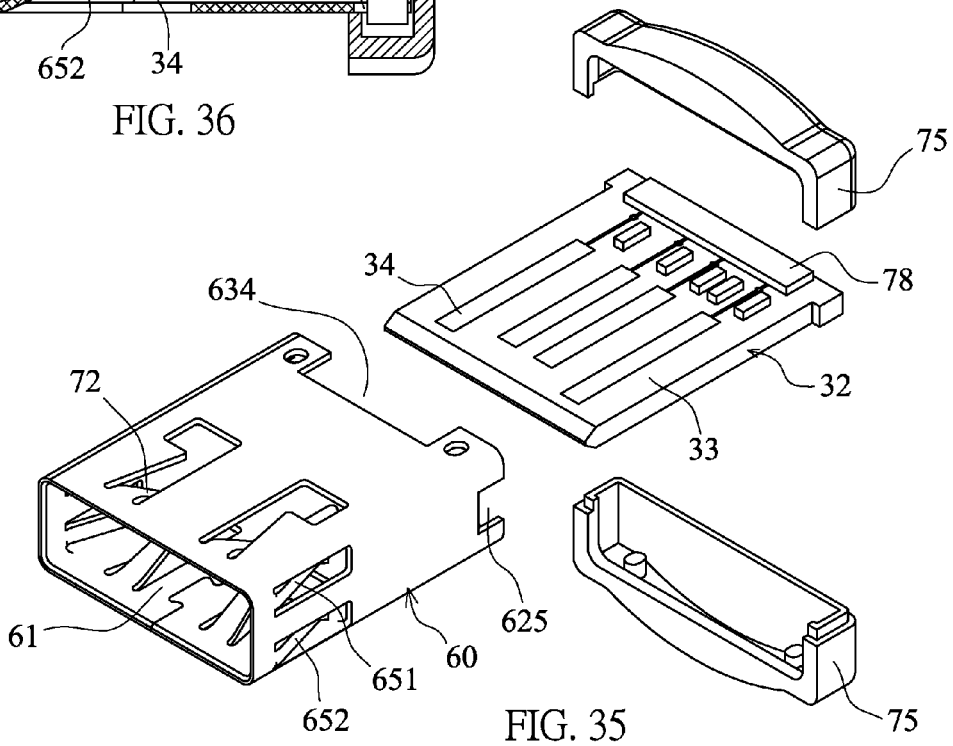
FIG. 35 is a pictorially exploded view showing the $16^{th}$ embodiment of the invention.

As shown in FIGS. 34 to 36, the 16$^{th}$ embodiment of the invention is a duplex electrical-connection wireless transceiver with the USB 2.0 specification and includes a printed circuit board 32, a socket shell 60, a position restricting structure, a returning structure 70, an electronic unit 78 and an external casing 75. The 16$^{th}$ embodiment is substantially the same as the fifth and 13$^{th}$ embodiments except for the difference that the electronic unit 78 of this embodiment is a wireless transceiver module. The overall length of this embodiment is very short, so the returning structure 70 only has two pairs of elastic returning sheets 72 resting against the top and bottom surfaces of the connection board 33. In addition, the rear sections of the top and bottom surfaces of the socket shell 60 are through slots 634 which do not cover the rear section of the printed circuit board 32. Thus, the wireless transceiver module has the better transceiving function, and an antenna or a projecting electronic element may be disposed.

Figure 37:
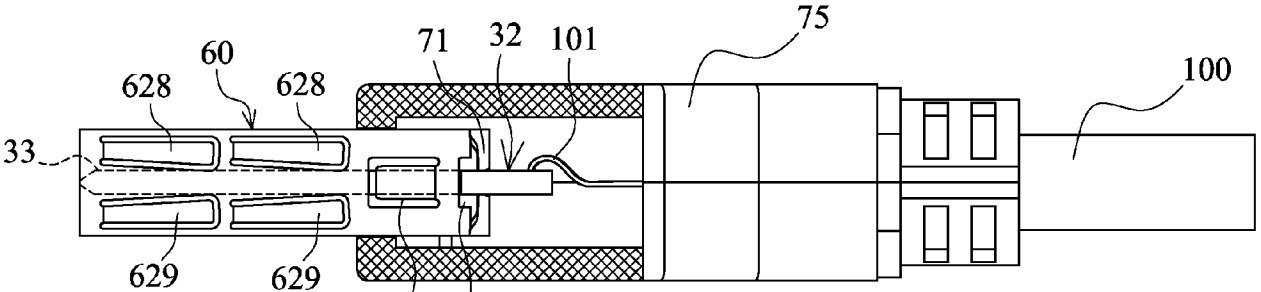
FIG. 37 is a side view showing a $17^{th}$ embodiment of the invention.
Figure 38:
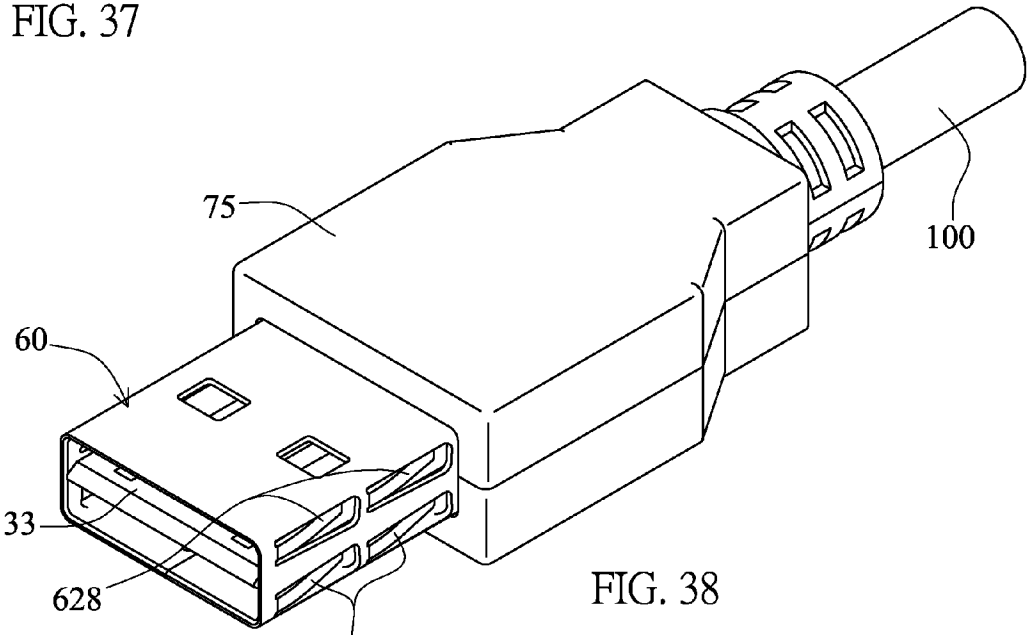
FIG. 38 is a pictorial view showing the $17^{th}$ embodiment of the invention.
Figure 39:
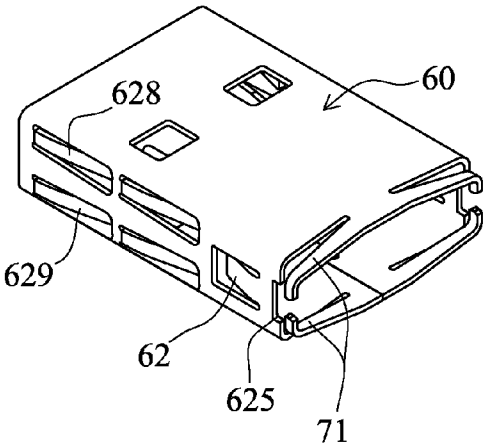
FIG. 39 is a pictorial view showing a socket shell according to the $17^{th}$ embodiment of the invention.

As shown in FIGS. 37 to 39, the 17$^{th}$ embodiment of the invention is a duplex electrical-connection electric cable and is substantially the same as the 13$^{th}$ embodiment except for the difference that this embodiment has the position restricting structure and the returning structure that are integrally provided. Two pairs of upper and lower position restricting and elastic returning sheets 628 and 629 are disposed on two sides of the front section of the socket shell 60. The upper and lower position restricting and elastic returning sheets 628 and 629 have roots connected to the socket shell 60. For the upper and lower position restricting and elastic returning sheets 628 and 629, the root and the rear section of contact point have a height difference, and the sheet slantingly extends from the root to the distal end. The upper and lower position restricting and elastic returning sheets 628 and 629 are tilted from the insert port of the connection slot 61 to the inside of the connection slot 61, and forwardly integrally extend to the distal ends and to be open. The upper and lower position restricting sheets can be laterally elastically moved and can be vertically elastically moved. For the upper and lower position restricting and elastic returning sheets 628 and 629, the height difference of the root corresponds to the movable region of the connection board 33. The upper and lower position restricting and elastic returning sheets 628 and 629 are symmetrically disposed on the top and bottom surfaces of the printed circuit board 32, so that the connection board 33 returns to the middle position of the height of the connection slot 61 and restricts the up and down movable positions of the printed circuit board 32 relative to the socket shell 60. The distal ends of contact points of the upper and lower position restricting and elastic returning sheets 628 and 629 can elastically rest against the printed circuit board 32 or approach the printed circuit board 32.

In addition, the position restricting structure and the returning structure are also disposed on the two side surfaces of the rear section of the socket shell 60 to return and restrict the rear section of the printed circuit board. The position restricting structure includes position restricting holes 625, and flanges are disposed on two sides of the printed circuit board 32 to engage with the position restricting holes 625. The printed circuit board 32 only can vertically float in the height region of the position restricting hole 625. The returning structure includes two pairs of elastic returning sheets 71 connected to the middle section of the top and bottom surfaces of the socket shell 60 and extending to two sides. The two pairs of elastic returning sheets 71 are disposed on the top and bottom surfaces on the two sides of the printed circuit board 32, and the distal ends of contact points of the elastic returning sheets 71 can elastically rest against the printed circuit board 32 or approach the printed circuit board 32.

Two pairs of upper and lower position restricting and elastic returning sheets 628 and 629 are disposed on two sides of the front section of the socket shell 60 of this embodiment, so that the connection board 33 of the front section of the printed circuit board 32 can return and can be restricted more stably.

The front end of the connection board 33 is nearer to the contact points of one of the pairs of upper and lower position restricting and elastic returning sheets 628 and 629. Thus, when the male connector is inserted into the female socket for electrical connection, the connection board is very stable. If the front end of the connection board 33 is improperly forced, the induced force is smaller since the arm of force is shorter.

Figure 40:
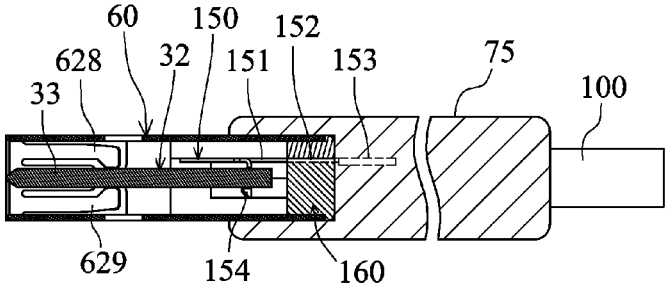
FIG. 40 is a cross-sectional side view showing an $18^{th}$ embodiment of the invention.
Figure 41:
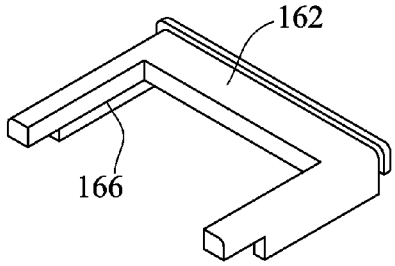
FIG. 41 is a partially pictorially assembled view showing the $18^{th}$ embodiment of the invention.
Figure 41:
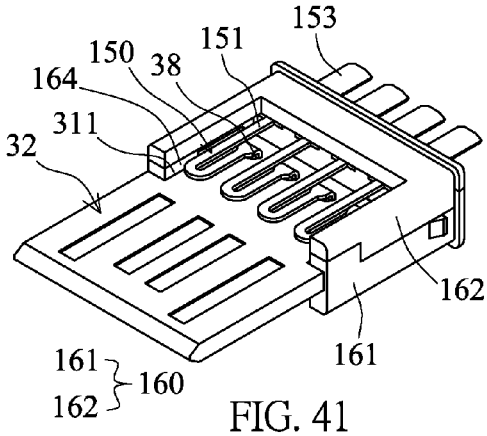
Figure 42:
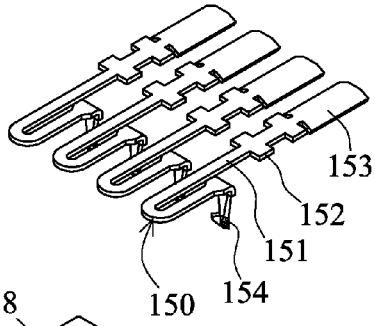
FIG. 42 is a partially pictorially exploded view showing the $18^{th}$ embodiment of the invention.
Figure 42:
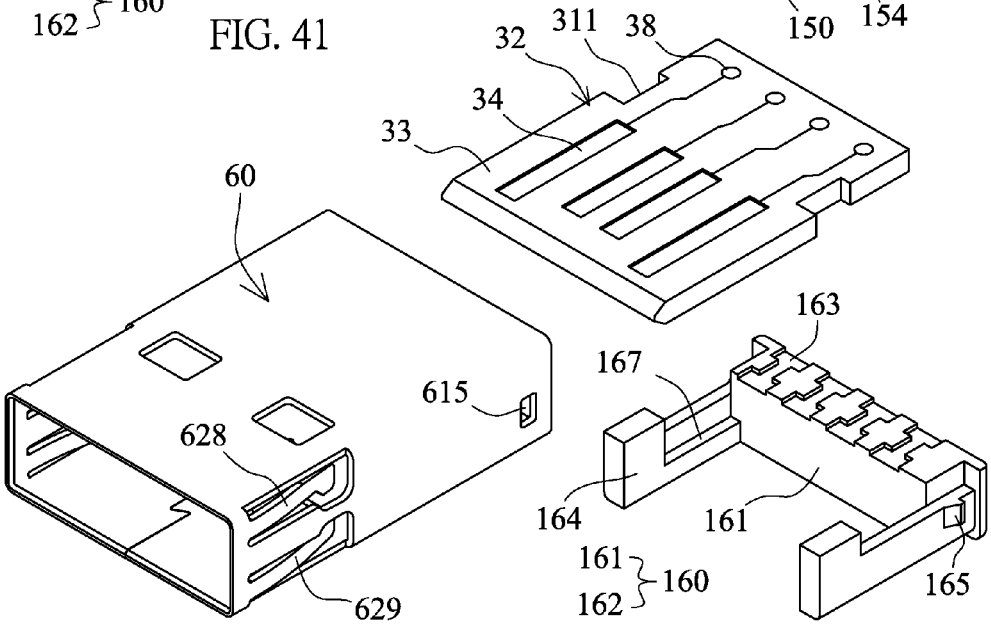

Referring to FIGS. 40 to 42, the $18^{th}$ embodiment of the invention is a duplex electrical-connection electric cable with the USB 2.0 specification and includes a printed circuit board 32, a socket shell 60, two pairs of upper and lower position restricting and elastic returning sheets 628 and 629, a connection cable 100 and an external casing 75, and is substantially the same as the $13^{th}$ and $17^{th}$ embodiments except for the following differences.

This embodiment further has a rear stopper block 160 and one row of connection terminals 150. The rear stopper block 160 is composed of a lower seat 161 and an upper seat 162 fitted and assembled with each other. The rear stopper block 160 has a middle section and two frontward extending side portions and is in the form of the inverse U-shape. The middle section of the rear stopper block has one row of I-shaped fixing slots 163. The inner surface of each of the two side portions of the rear stopper block is in the form of a concave portion. The front end of the concave portion is formed with an engagement block 164. The top of the concave portion is formed with a top position restricting surface 166 (on the upper seat 162). The bottom of the concave portion is formed with a bottom position restricting surface 167 (on the lower seat 161). A tongue 165 is disposed on the rear end of each of the two side portions of the rear stopper block. The connection terminal 150 has, from front to rear, an elastic arm 151, a fixing portion 152 and a pin 153. The elastic arm 151 is in the form of a U shape and has an open end formed with a contact. The contact has a downwardly extending inverse hook 154, which hooks the electroconductive through hole 38 of the printed circuit board 32 and is then soldered. The one row of electroconductive through hole 38 are one row of electroconductive portions. The fixing portion 152 is also in the form of the I-shape and is engaged with the fixing slot 163 of the rear stopper block 160. The pins 153 surround the wires of the connection cable 100. The engagement holes 311 on two sides of the printed circuit board 32 engage with the engagement blocks 164 of the rear stopper block 160, so that the printed circuit board 32 only can move up and down relative to the rear stopper block 160 but cannot move in the front-to-rear direction. Because the elastic arm 151 of the connection terminal 150 can be vertically elastically moved, the printed circuit board 32 can smoothly move up and down relative to the rear stopper block 160. The top position restricting surface 166 and the bottom position restricting surface 167 of the rear stopper block also have the effect of vertically restricting the printed circuit board 32. The one row of connection terminals 150 also have the effect of returning the printed circuit board 32 to the home position.

During the assembling processes, the rear stopper block 160 is combined with the connection terminal 150, the printed circuit board 32 and the connection cable 100, and then plugged from the rear into the socket shell 60 in a tight fitting state. The tongue 165 of the rear stopper block 160 engages with the engagement hole 615 of the socket shell 60. Finally, the encapsulation is performed to form the external casing 75. By plugging the rear stopper block 160 into the socket shell 60 tightly, the encapsulating material cannot flow into the socket shell 60.

Figures 43, 44:
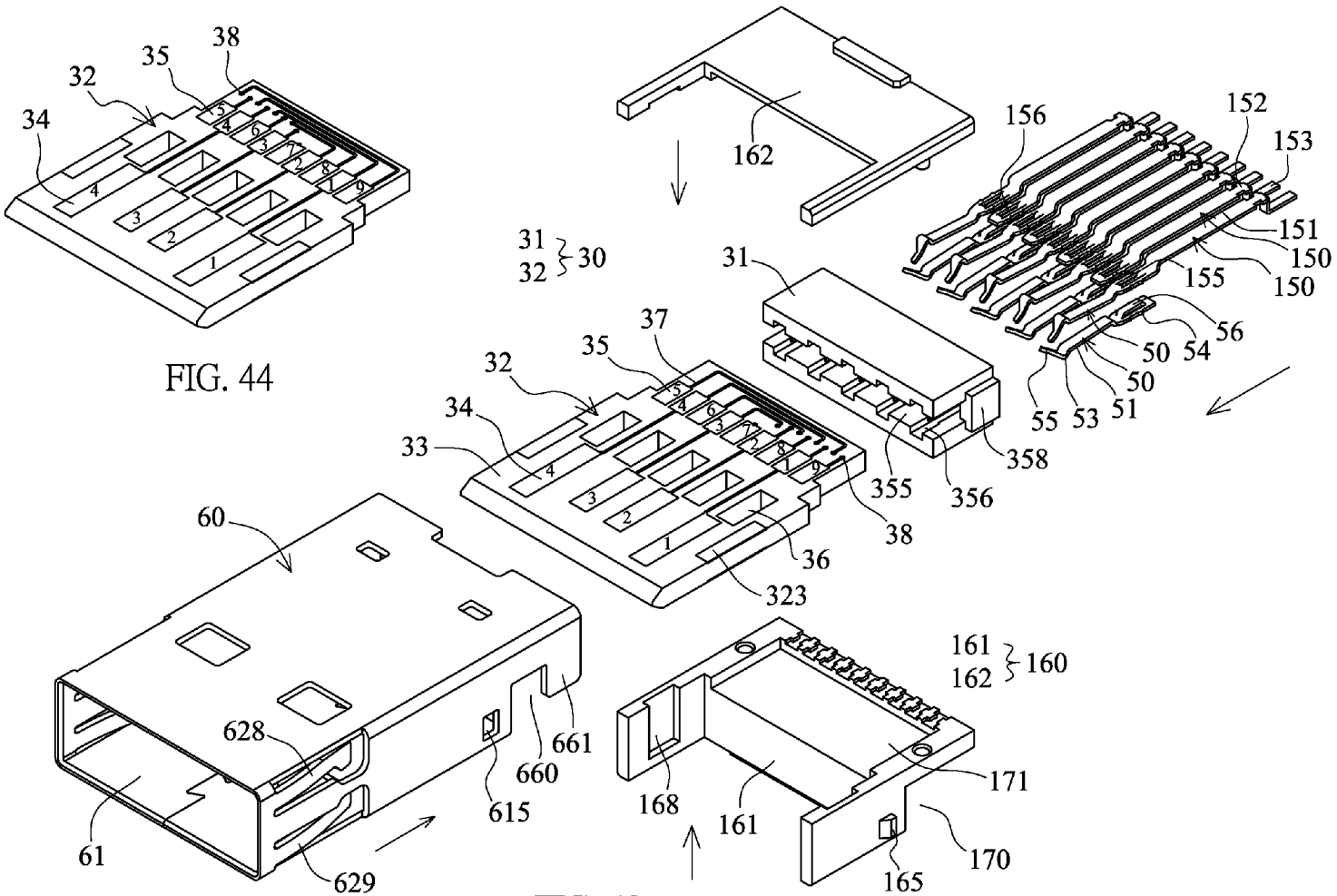
FIG. 43 is a pictorially exploded view showing a $19^{th}$ embodiment of the invention.
FIG. 44 is a backside pictorial view showing a printed circuit board according to the $19^{th}$ embodiment of the invention.
Figure 45:
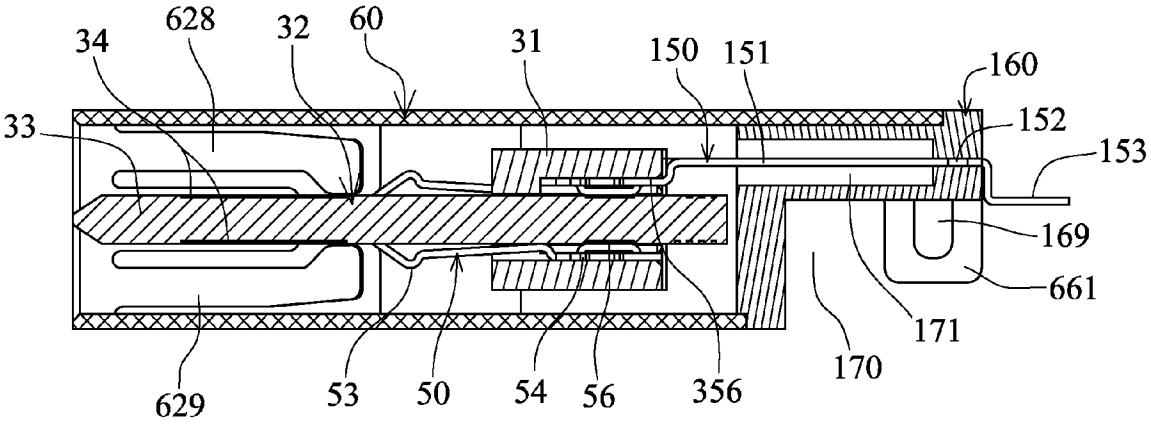
FIG. 45 is a cross-sectional side view showing the $19^{th}$ embodiment of the invention.

Referring to FIGS. 43 to 45, a duplex male electrical connector with the USB 3.0 specification according to the $19^{th}$ embodiment of the invention includes an insulating base 30, two rows of second terminals 50, a socket shell 60, two pairs of upper and lower position restricting and elastic returning sheets 628 and 629, one row of connection terminals 150 and a rear stopper block 160, and is substantially the same as the first embodiment.

The insulating base 30 includes a plastic seat 31 and a printed circuit board 32. The plastic seat 31 has a horizontal socket space 355 and two rows of terminal slots 356. An engagement block 358 is disposed on each of two sides of the plastic seat 31. The printed circuit board 32 is a hard board, which cannot be elastically moved and distorted and has a front section serving as a connection board 33. One row of four first connection contacts 34 are disposed on each of the top and bottom surfaces of the connection board 33. The two rows of first connection contacts 34 are circuit connection contacts of the printed circuit board and may be golden fingers. The front end of the connection board 33 is formed with upper and lower inclined guiding surfaces 39 and is tapered. One row of five through slots 36 are disposed in the back of the first connection contact 34. One row of nine bonding pads 35 are disposed on each of the top and bottom surfaces of the rear section of the printed circuit board 32, wherein the one row of bonding pads 35 are one row of electroconductive portions, and five bonding pads 35 correspond to the one row of five through slots 36, and each first connection contact 34 is connected to one bonding pad 35 by the trace 37. A wear resisting pad 323 is disposed on each of the two sides of the top and bottom surfaces of the connection board 33. The socket space 355 of the plastic seat 31 is fitted and engaged with the rear section of the printed circuit board 32. The connection board 33 of the front section of the printed circuit board is projectingly disposed in front of the plastic seat 31.

In addition, the plastic seat 31 may also have upper and lower seats stacked and fixed with the printed circuit board 32 in a vertical direction.

Each of the two rows of second terminals 50 contain five terminals. The second terminal has an extension 51 and a fixing portion 54. The extension 51 can be vertically elastically moved and has a projecting second connection contact 53. The inclined guiding surfaces 55 with the narrower plate surfaces are disposed in front of the second connection contacts 53. The plate surfaces of the fixing portion 54 are pressed to form projecting pins 56. The two rows of second terminals 50 are assembled with and fixed to the two rows of terminal slots 356 of the plastic seat 31 through the fixing portion 54. Then, the plastic seat 31 is combined with the rear section of the printed circuit board 32. The pins 56 of the two rows of second terminals 50 are bonded to the two rows of bonding pads 35. The two rows of second connection contacts 53 project from the top and bottom surfaces of the connection board 33, respectively. The inclined guiding surfaces 55 of the two rows of second connection contacts 53 can be vertically elastically moved in the through slot 36. The second connection contacts 53 of the two rows of second terminals 50 correspond to each other in the vertically direction. The inclined guiding surfaces 55 of the two rows of second terminals 50 are staggered in the left-to-right direction, so that the two rows of second terminals 50 cannot touch each other when being vertically elastically moved. The second connection contact 53 is disposed in the back of the first connection contact 34. The one row of first connection contacts 34 and the one row of second connection contacts 53 form the USB 3.0 contact interface. The trace serial numbers of the two rows of first connection contacts 34 are arranged reversely. The trace serial numbers of the two rows of second connection contacts 53 are arranged reversely. The same trace serial numbers of the two rows of first connection contacts 34 are electrically connected together to form a cascaded set through the electroconductive through holes 38. The same trace serial numbers of the two rows of second connection contacts 53 are electrically connected together to form a cascaded set through the electroconductive through hole 38. The descriptions for the trace serial numbers are the same as those of the first embodiment.

The one row of connection terminals 150 contain nine terminals. The connection terminal 150 has, from front to rear, an elastic arm 151, a fixing portion 152 and a pin 153. The elastic arm 151 extends horizontally and linearly and has a front end formed with a fixing portion 155. The plate surfaces of the fixing portion 155 are pressed to form projecting contacts 156, the fixing portions 155 of the one row of connection terminals 150 are assembled with and fixed to the terminal slots of the plastic seat 31. The contact 156 is bonded to the bonding pad 35 of the printed circuit board.

Five terminals of the one row of connection terminals 150 are integrally connected to five second terminals 50 of the upper row.

The rear stopper block 160 is composed of a lower seat 161 and an upper seat 162 fitted and assembled together, and the rear stopper block 160 has a middle section and two frontward extending side portions and is in the form of an inverse U-shape. The middle section of the rear stopper block has one row of I-shaped fixing slots 163, and the bottom portion of the rear stopper block has a notch 170 to form the inverse L-shape. An elastic movement space 171 is disposed in front of the one row of fixing slots 163. A tongue 165 is disposed on the outer surface of each of the two side portions, and a vertical slot 168 is disposed on the inner surface of each of the side portions.

The fixing portions 152 of the one row of connection terminals 150 engage with the one row of fixing slots 163 of the rear stopper block 160. The pin 153 horizontally extends to the back of the rear stopper block 160. The engagement blocks 358 on two sides of the plastic seat engage with the two slots 168 of the rear stopper block 160, so that the insulating base 30 only can move up and down relative to the rear stopper block 160 but cannot move in the front-to-rear direction. Because the elastic arm 151 of the connection terminal 150 can be vertically elastically moved, the vertical movement of the printed circuit board 32 relative to the rear stopper block 160 is very smooth. The top and bottom surfaces of the plastic seat 31 may have the effect of vertically restricting the printed circuit board 32 when resting against the socket shell 60. The elastic arms 51 of the one row of connection terminals 150 also have the effect of returning the printed circuit board 32 to the home position.

The socket shell 60 is made of a metal material and covers the insulating base 30. A connection slot 61 is formed in the socket shell 60 and has a front end serving as an insert port. Each of the two side surfaces of rear section of the socket shell 60 is formed with a notch 660 and a card 661 and has the open bottom of the rear section. An engagement hole 615 is disposed near the rear end of each of the two side surfaces. The connection board 33 is disposed in the connection slot, so that a vertical floating gap is formed between the insulating base 30 and the socket shell 60, and the socket shell 60 and the connection board 33 can vertically float and move relative to each other.

The two pairs of upper and lower position restricting and elastic returning sheets 628 and 629 are disposed on the front sections of two sides of the socket shell 60, and have the structures the same as those of the $17^{th}$ embodiment. The two pairs of upper and lower position restricting and elastic returning sheets 628 and 629 may rest against the wear resisting pads 323 on the two sides of the top and bottom surfaces of the connection board 33.

During the assembling processes, the rear stopper block 160 is combined with the connection terminal 150 and the insulating base 30, and then plugged from the rear into the socket shell 60 in a tight fitting state. The rear stopper block 160 tightly plugging into the rear end of the socket shell 60 makes a notch be formed below the rear section of the socket shell. The tongue 165 of the rear stopper block 160 engages with the engagement hole 615 of the socket shell 60, so that a duplex male electrical connector with the USB 3.0 specification is formed. The pins 153 of the one row of connection terminals 150 of the rear end thereof can be electrically connected to an electronic unit, and then an electronic device is formed after combining with an external casing.

Figure 46:
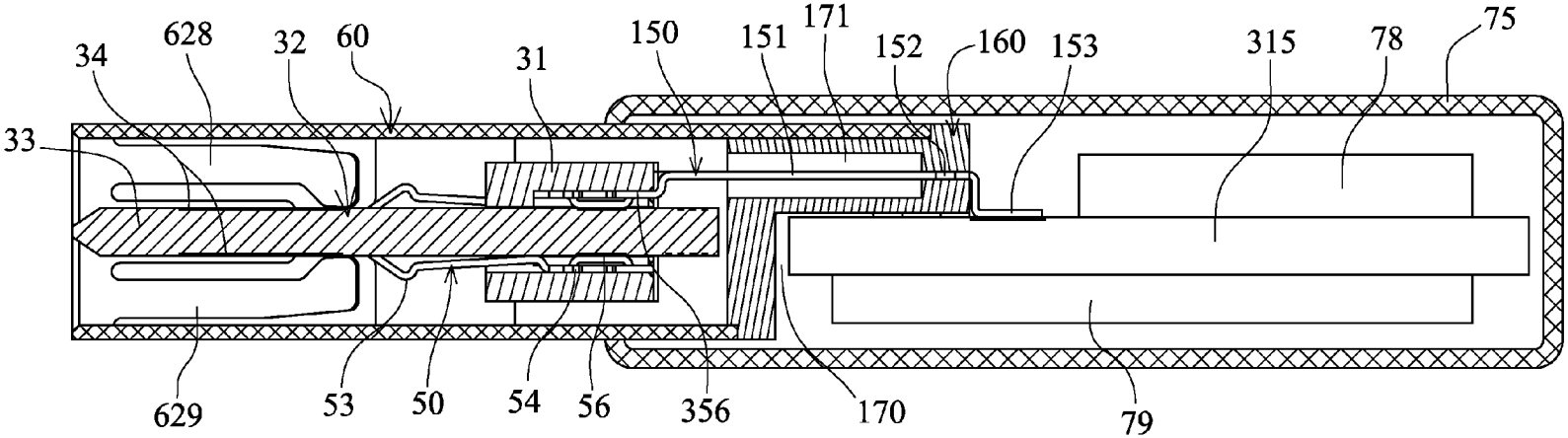
FIG. 46 is a cross-sectional side view showing the $19^{th}$ embodiment of the invention serving as a mobile disk.

As shown in FIG. 46, an implemented state of a mobile disk is provided. The pins 153 of the one row of connection terminals 150 are electrically connected to a printed circuit board 315, on which an electronic unit 78 is disposed. The electronic unit 78 is a storage unit. Then, an external casing 75 is provided to cover the printed circuit board 315 and combined with the rear section of the socket shell 60. The cards 661 on two sides of the socket shell 60 and the engaging post 169 of the rear stopper block 160 can pass through the printed circuit board 315 for engagement. Because this embodiment pertains to the sunk board design, the printed circuit board 315 may be combined with the notch 170 of the rear stopper block 160, and can be located at the middle height of the socket shell 60, so that the electronic unit 78 or another electronic element 79 can be disposed on the top and bottom surfaces of the printed circuit board 315.

In addition to the advantages of the first embodiment, this embodiment further has the following advantages.

1. The standard specification of the duplex male electrical connector is provided. The pins 153 of the one row of connection terminals 150 at the rear end of the male electrical connector can be electrically connected to an electronic unit, and then combined with an external casing to form the electronic device, or is combined with an electric cable.

2. The rear stopper block 160 disposed on the rear end of the socket shell 60 can resist the dust and the flowing glue.

3. The top and bottom surfaces of the plastic seat 31 have the effect of vertically restricting the printed circuit board 32 when resting against the socket shell 60.

4. The elastic arms 51 of the one row of connection terminals 150 also have the effect of returning the printed circuit board 32 to the home position.

5. The embodiment provides the sunk board design, and the printed circuit board 315 can be combined with the notch 170 of the rear stopper block 160, and thus can be located at the middle height of the socket shell 60, so that the electronic unit 78 or another electronic element 79 can be disposed on the top and bottom surfaces of the printed circuit board 315.

6. The plastic seat 31 fixes the fixing portions of the two rows of second terminals, and restricts the left/right position and the elastic moving heights of the extensions 51 of the two rows of second terminals. The gaps between the top and bottom ends of the plastic seat 31 and the socket shell 60 can restrict the floating height of the connection board.

Figures 47, 48:
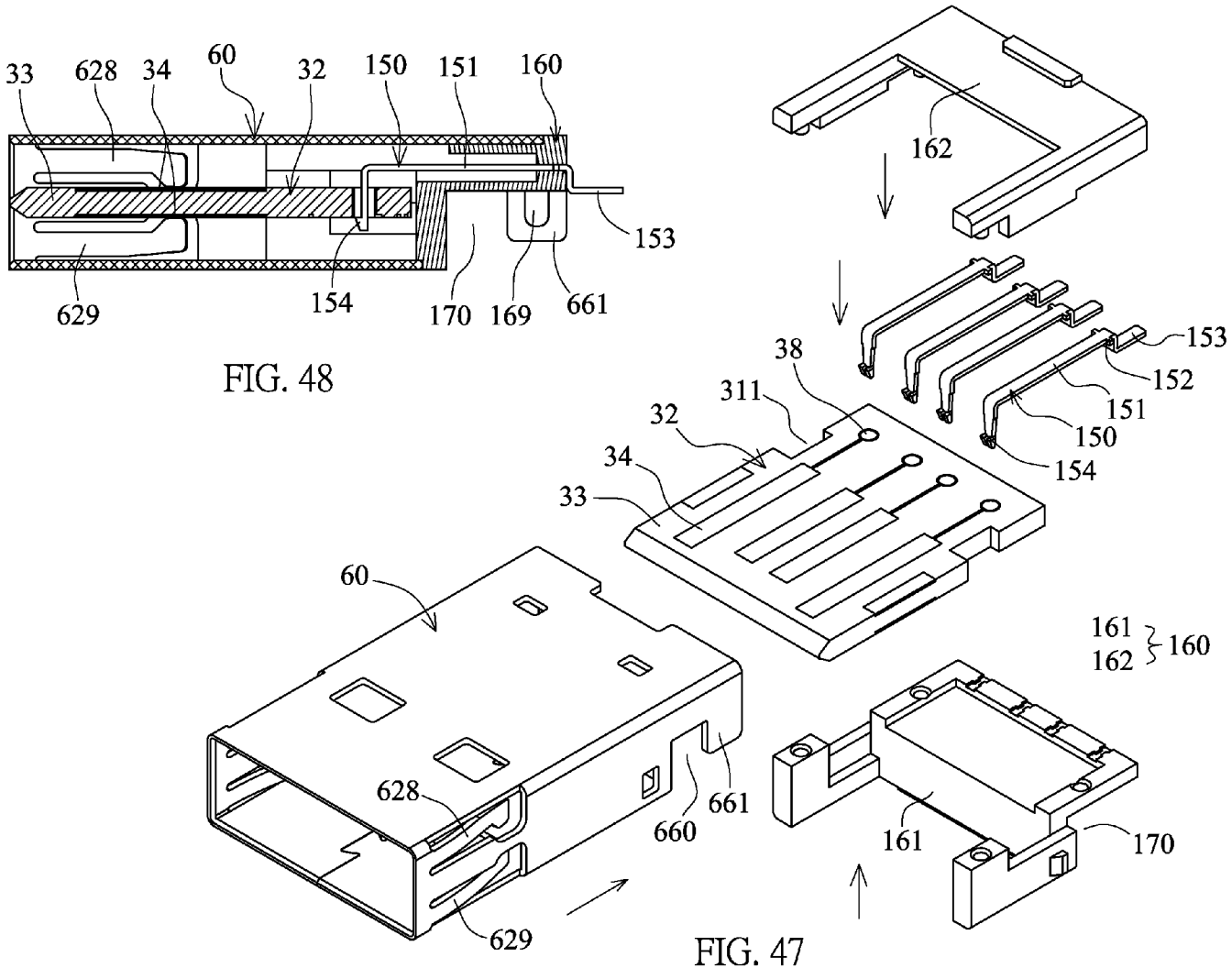
FIG. 47 is a pictorially exploded view showing a $20^{th}$ embodiment of the invention.
FIG. 48 is a cross-sectional side view showing the $20^{th}$ embodiment of the invention.

Referring to FIGS. 47 and 48, a duplex male electrical connector with the USB 2.0 specification according to the 20$^{th}$ embodiment of the invention is substantially the same as that of the 18$^{th}$ embodiment except for the difference that the socket shell 60 and the rear stopper block 160 are similar to those of the 19$^{th}$ embodiment and pertain to the sunk board design. The pins 153 of the one row of connection terminals 150 are horizontal pins, which can be electrically connected to an electronic unit, so that an electronic device is formed after combined with an external casing. The electronic device is, for example, a mobile disk, an IC controller, a wireless transceiver, MP3, GPS, a voice recorder, a television receiving module, a wireless network adapter module, a digital camera, an adapter connector, other electronic devices, or the like.

Figure 49:
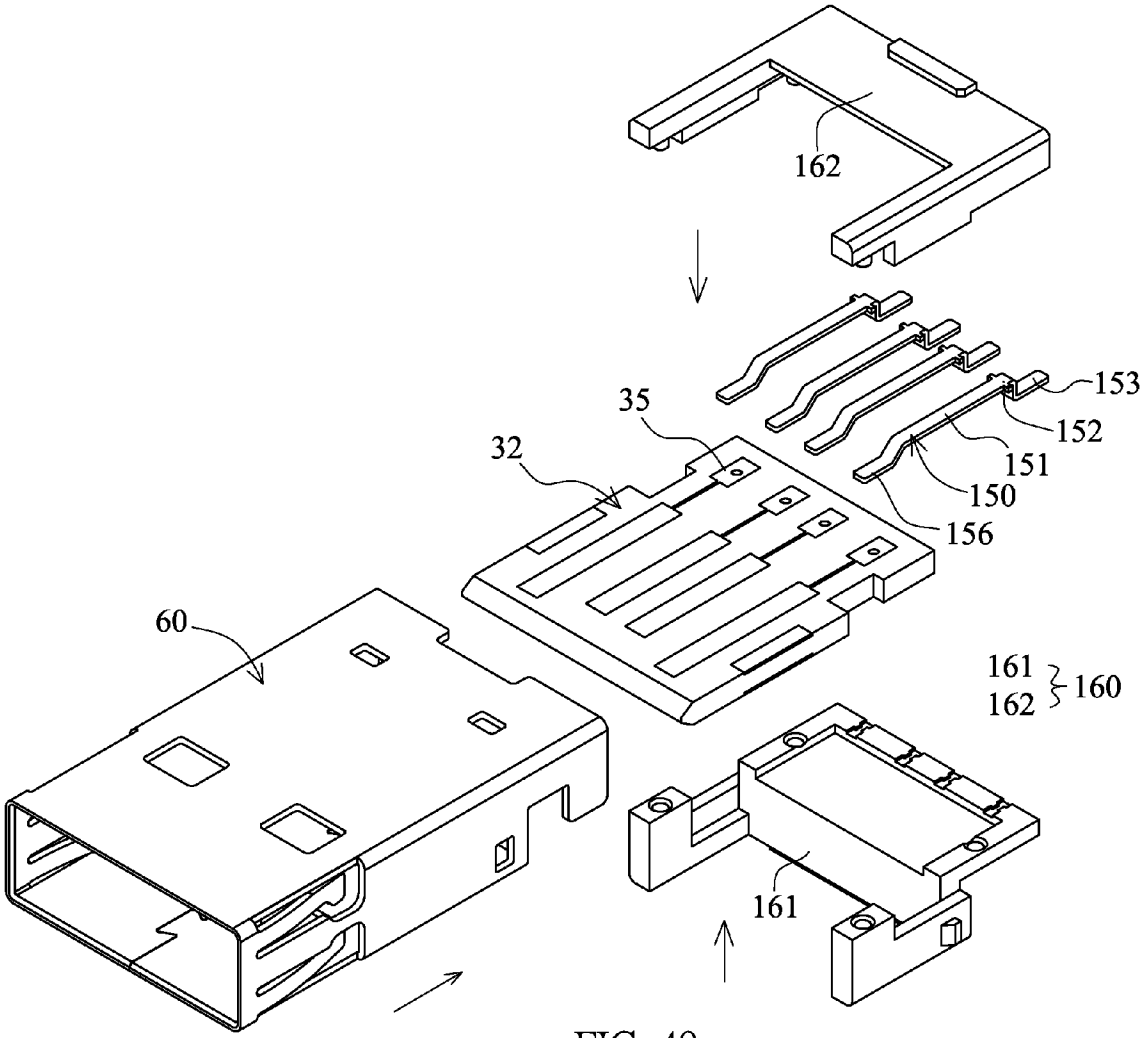
FIG. 49 is a pictorially exploded view showing a 21st embodiment of the invention.

As shown in FIG. 49, a duplex male electrical connector with the USB 2.0 specification according to the 21$^{st}$ embodiment of the invention is substantially the same as that of the 20$^{th}$ embodiment except for the difference that the front end of each of the one row of connection terminals 150 is a horizontal contact 156, which is bonded to the bonding pad 35 of the printed circuit board 32.

Figure 50:
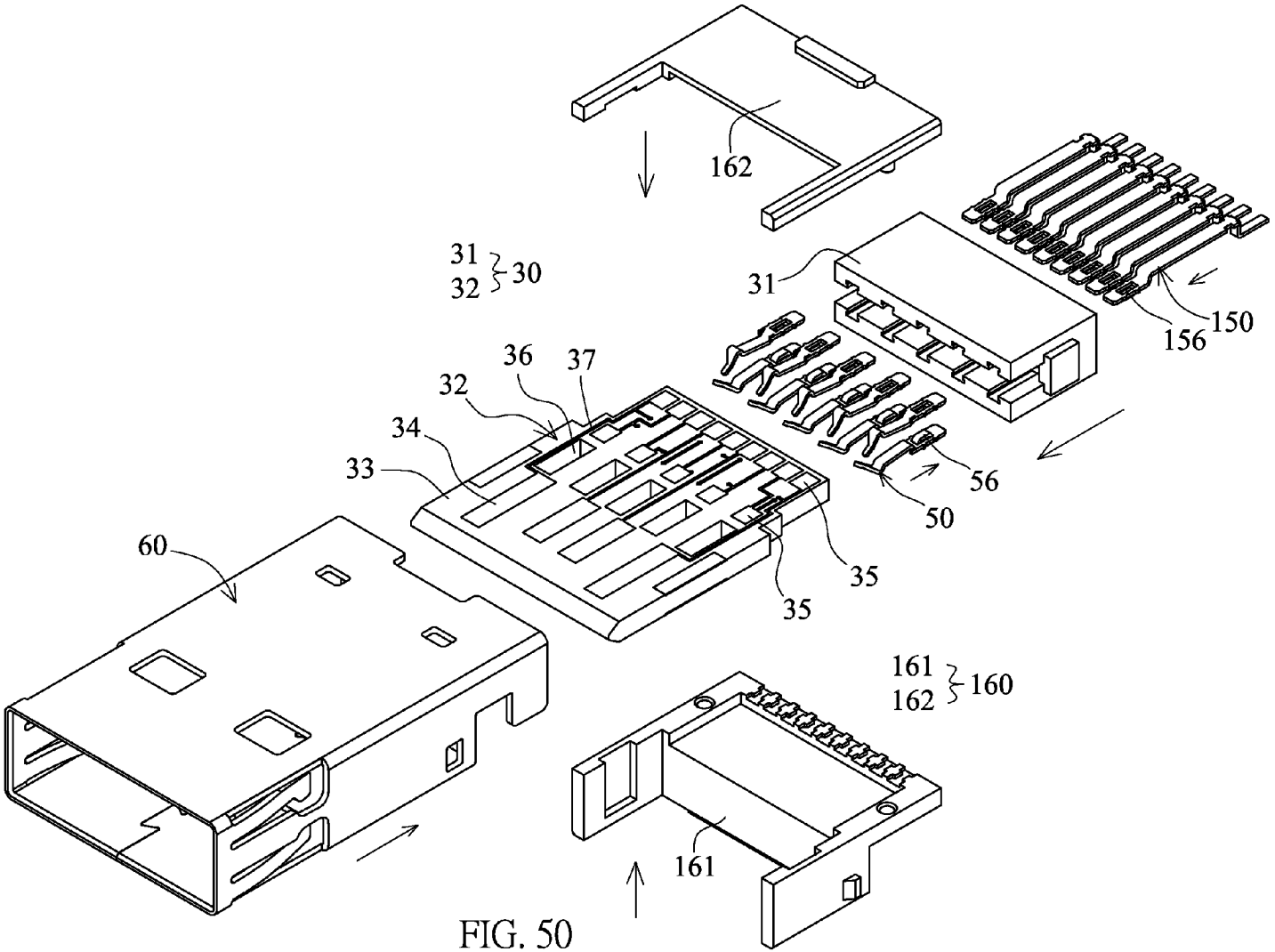
FIG. 50 is a pictorially exploded view showing a 22nd embodiment of the invention.

As shown in FIG. 50, a duplex male electrical connector with the USB 3.0 specification according to the 22$^{nd}$ embodiment of the invention is substantially the same as the 19$^{th}$ embodiment except for the difference that the upper row of second terminals 50 are not integrally connected to the connection terminal 150, and one row of five bonding pads 35 are further disposed in front of the one row of nine bonding pads 35 and on each of the top and bottom surfaces of the printed circuit board 32. The pins 56 of the two rows of second terminals 50 are bonded to the two rows of five bonding pads 35, and the contacts 156 of the one row of connection terminals 150 are bonded to the one row of nine bonding pads 35. In addition, the circuit layouts on two sides of the first connection contact 34 are disposed outside the one row of five bonding pad 35, so that the better high-frequency transmission effect can be obtained.

Figure 51:
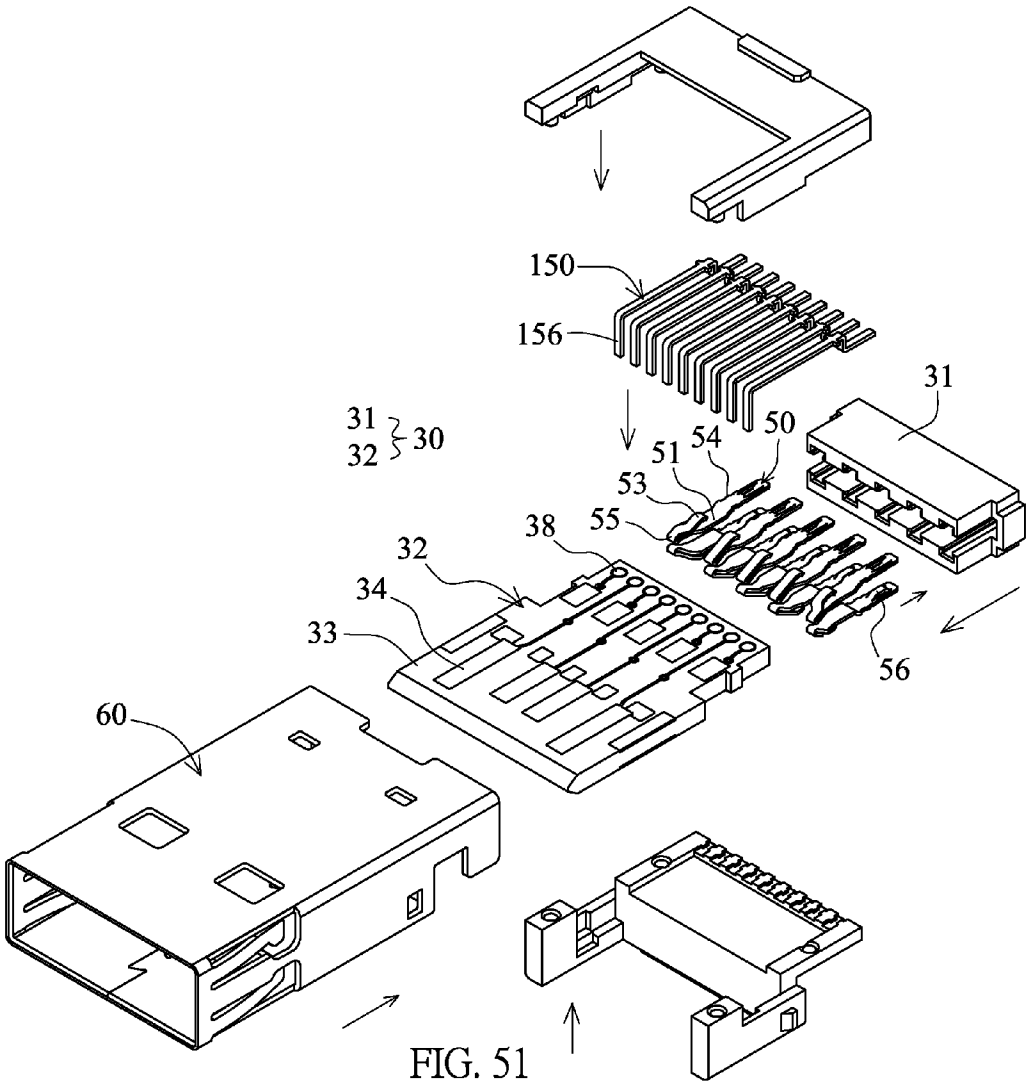
FIG. 51 is a pictorially exploded view showing a 23rd embodiment of the invention.
Figure 52:
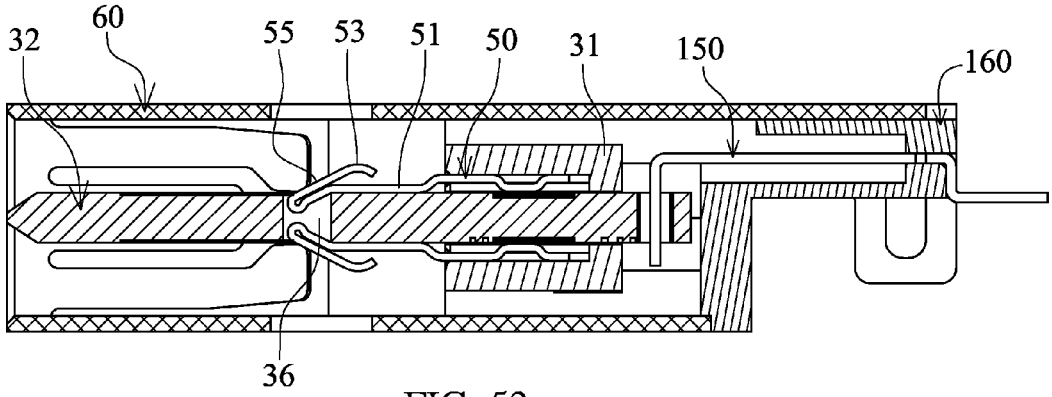
FIG. 52 is a cross-sectional side view showing the 23rd embodiment of the invention.

As shown in FIGS. 51 and 52, a duplex male electrical connector with the USB 3.0 specification according to the 23$^{rd}$ embodiment of the invention is substantially the same as that of the 22$^{nd}$ embodiment, except for the difference that one row of nine bonding pads on the rear end of the printed circuit board 32 are modified into electroconductive through holes 38, and the front end of the connection terminal 150 is a vertical contact 156. The contact 156 of the connection terminal 150 is inserted into the electroconductive through hole 38 and bonded thereto. The front end of the extension 51 of each of the two rows of second terminals 50 is inversely bent to form a projecting second connection contact 53 and an inclined guiding surfaces 55, so that the second connection contact 53 extends along the inserting direction, the extension 51 is in flat surface contact with the printed circuit board 32 and the inclined guiding surfaces 55 fall into the through slot 36. When the second connection contact 53 is pressed, the inclined guiding surfaces 55 tilt reversely, so the inclined guiding surfaces 55 of the two rows of second terminals 50 cannot touch each other.

Figure 53:
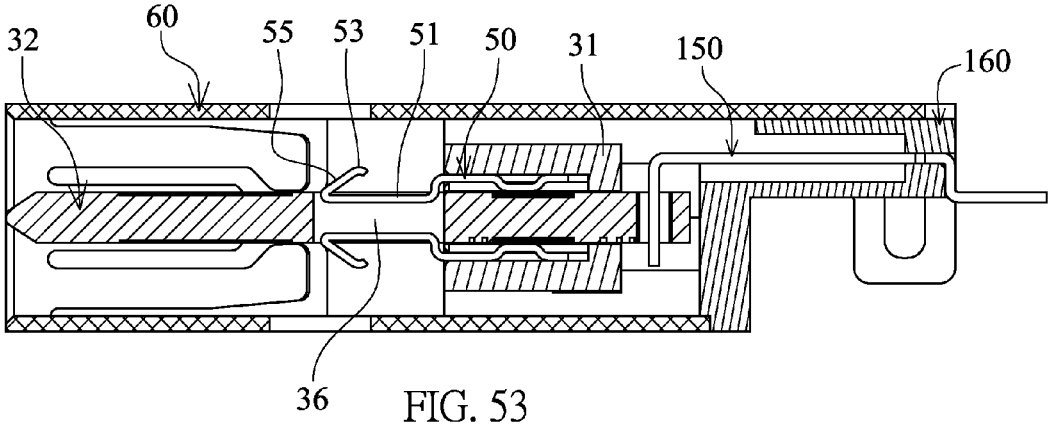
FIG. 53 is a cross-sectional side view showing a 24th embodiment of the invention.

As shown in FIG. 53, a duplex male electrical connector with the USB 3.0 specification according to the 24$^{th}$ embodiment of the invention is substantially the same as that of the 23$^{rd}$ embodiment, in which the second connection contact also runs along the inserting direction, except for the difference that the extension 51 of the second terminal 50 horizontally and linearly extends and is disposed in the through slot 36.

Figure 54:
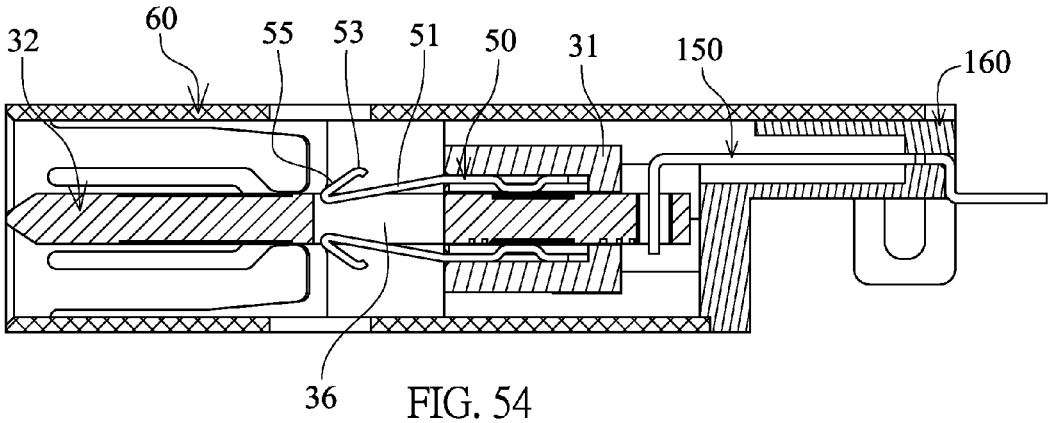
FIG. 54 is a cross-sectional side view showing a 25th embodiment of the invention.

As shown in FIG. 54, a duplex male electrical connector with the USB 3.0 specification according to the 25$^{th}$ embodiment of the invention is substantially the same as that of the 24$^{th}$ embodiment except for the difference that the extension 51 of the second terminal 50 slantingly and linearly extends toward the through slot 36.

Figure 55:
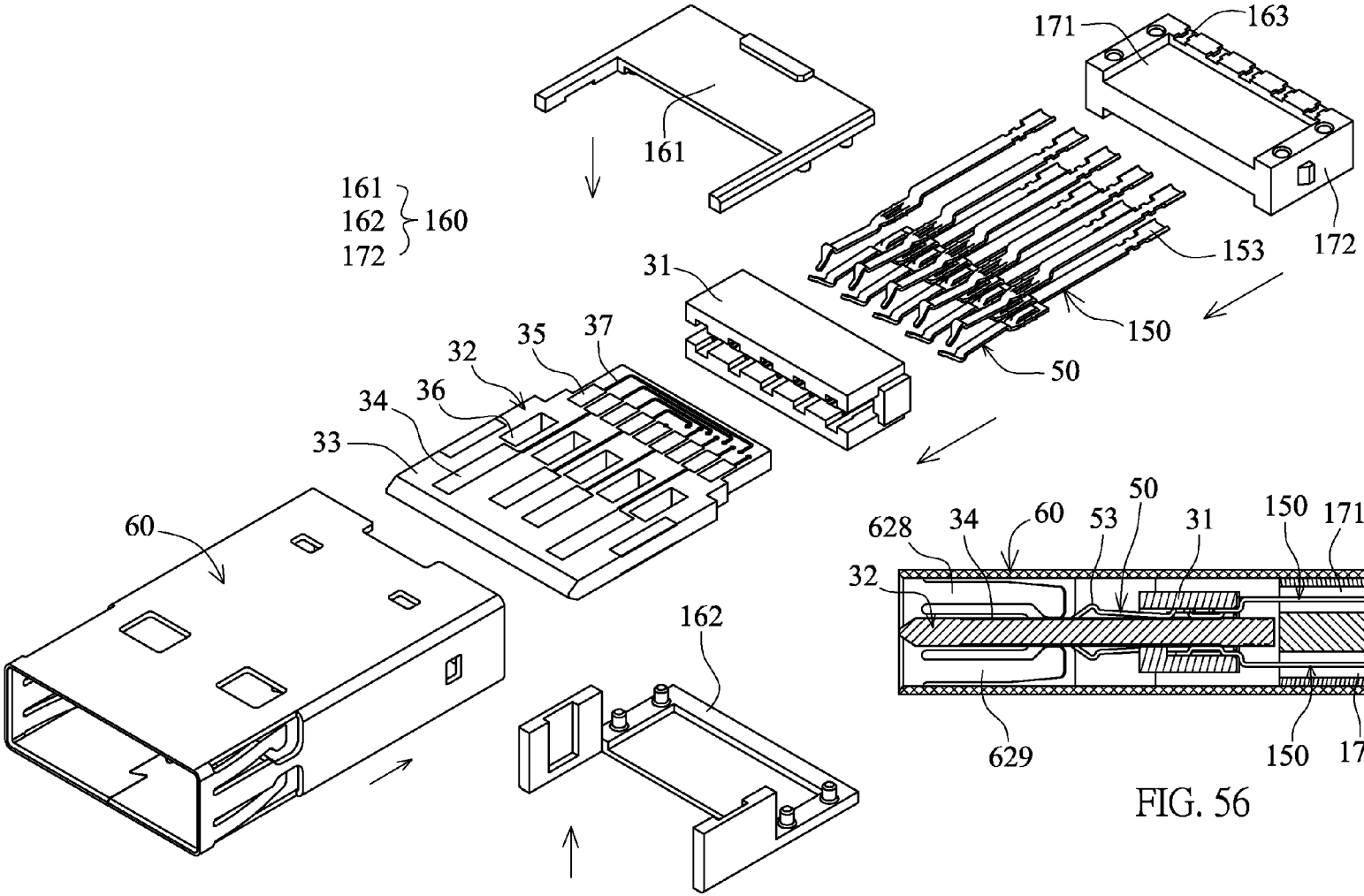
FIG. 55 is a pictorially exploded view showing a 26th embodiment of the invention.
Figure 56:
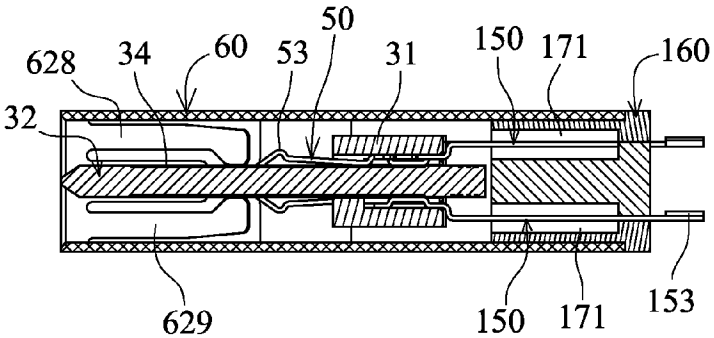
FIG. 56 is a cross-sectional side view showing the 26th embodiment of the invention.

As shown in FIGS. 55 and 56, a duplex male electrical connector with the USB 2.0 specification according to the 26$^{th}$ embodiment of the invention is substantially the same as that of the 19$^{th}$ embodiment except for the difference that the nine connection terminals 150 are arranged in two rows and bonded to the top and bottom surfaces of the printed circuit board 32, wherein the upper row contains five terminals, the lower row contains four terminals, and the pin 153 is arced and can clip and surround the wires. In addition, the rear stopper block 160 is composed of a lower seat 161, a middle seat 172 and an upper seat 162 fitted and assembled together. The middle section thereof has two rows of fixing slots 163, and an elastic movement space 171 is disposed in front of each of the two rows of fixing slots 163.

Figure 57:
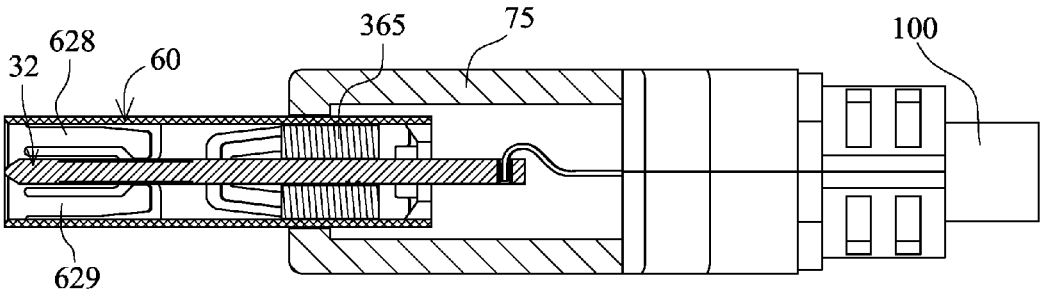
FIG. 57 is a cross-sectional side view showing a 27th embodiment of the invention.

As shown in FIG. 57, a duplex electrical-connection electric cable with the USB 2.0 specification according to the 27$^{th}$ embodiment of the invention is substantially the same as those of the 17$^{th}$ embodiment except for the difference that an elastomer 365 is filled into the rear section of the socket shell 60 and can elastically press and return the printed circuit board 32 to the middle-section position. In addition, the elastomer 365 forms a block in the front-to-rear direction in the socket shell 60 and can achieve the effect of dustproof and anti-oxidation. The elastomer 365 may be a soft glue, a silica gel, a sponge, an EPE (Expand able poly ethylene), or the like.

Figure 58:
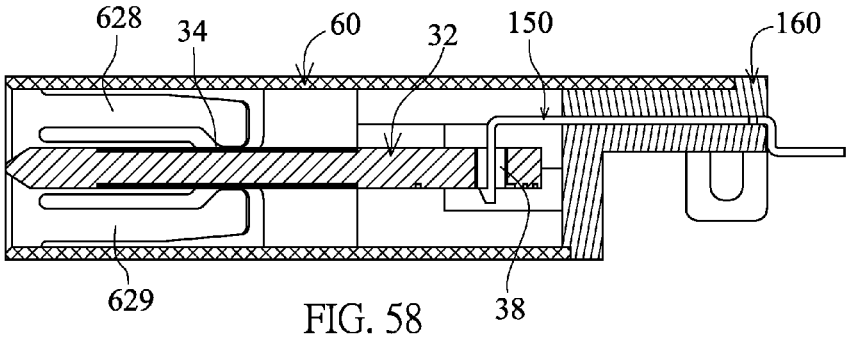
FIG. 58 is a cross-sectional side view showing a 28th embodiment of the invention.

As shown in FIG. 58, a duplex male electrical connector with the USB 2.0 specification according to the 28$^{th}$ embodiment of the invention is substantially the same as that of the 20$^{th}$ embodiment except for the difference that the printed circuit board 32 is a flexible board, which can be elastically moved vertically, and the portion of the printed circuit board 32 near the rear end of the printed circuit board 32 is fixed by the one row of connection terminals 150, which cannot be substantially elastically moved.

Figure 59:
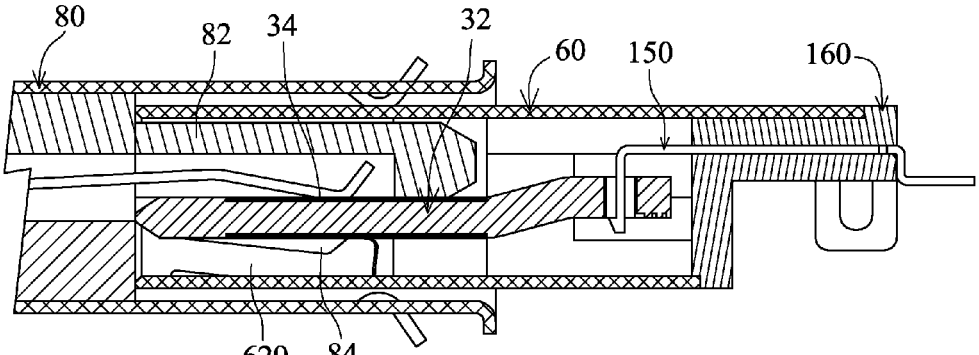
FIG. 59 is a cross-sectional side view showing the used state according to the 28th embodiment of the invention.

As shown in FIG. 59, when the male connector is inserted into the USB 2.0 female socket 80 for electrical connection, the rear section of the printed circuit board 32 may be distorted so that the connection board of the front section of the printed circuit board 32 is moved downward and can be connected to the connection slot 84 below the tongue 82 of the USB 2.0 female socket 80.

Figure 60:
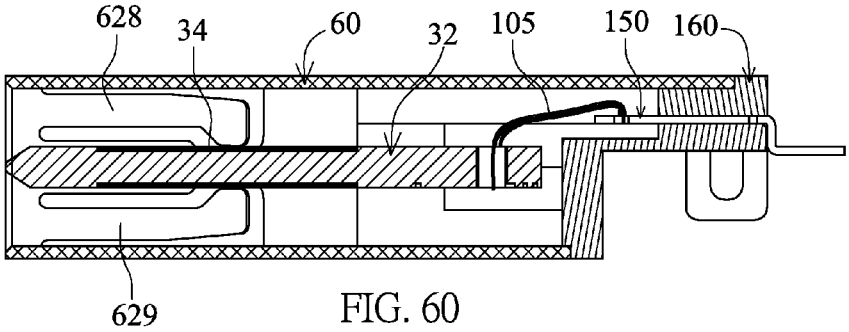
FIG. 60 is a cross-sectional side view showing a 29th embodiment of the invention.

As shown in FIG. 60, a duplex male electrical connector with the USB 2.0 specification according to the 29$^{th}$ embodiment of the invention is substantially the same as that of the 20$^{th}$ embodiment except for the difference that the connection terminals 150 are electrically connected to the printed circuit board 32 through wires 105. In this embodiment, the printed circuit board 32 may be a hard board or a soft board.

Figure 61:
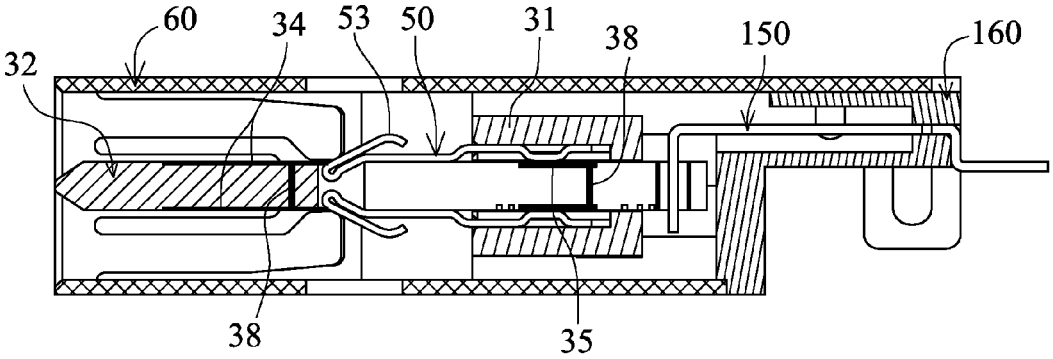
FIG. 61 is a cross-sectional side view showing a 30th embodiment of the invention.
Figure 62:
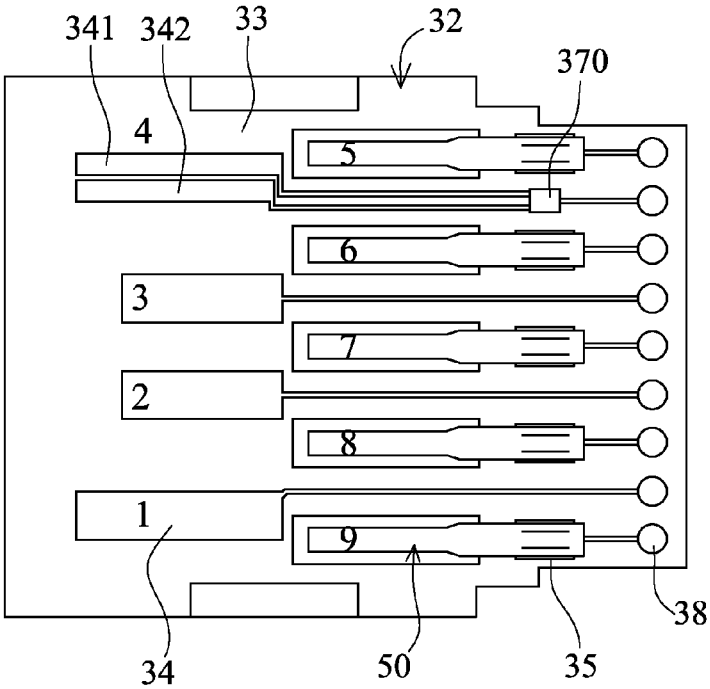
FIG. 62 is a top view showing a printed circuit board according to the 30th embodiment of the invention.

As shown in FIGS. 61 and 62, a duplex male electrical connector with the USB 3.0 specification according to the 30$^{th}$ embodiment of the invention is substantially the same as that of the 23$^{rd}$ embodiment except for the difference that two vertically corresponding first connection contacts in the two rows of first connection contacts 34 are directly electrically connected together through the electroconductive through holes 38 to form a cascaded set, and two vertically corresponding second connection contacts in the two rows of second connection contacts 53 are also directly electrically connected together through the electroconductive through holes 38 to form another cascaded set rather than the reversely arranged cascaded set. Thus, the cascaded traces may be formed more easily and the traces cannot interfere with each other to affect the high-frequency transmission.

The cascaded manner of this embodiment needs to work in conjunction with a detection device and a conversion controller. The conversion controller may perform the trace serial number conversion, and is an electronic element with a control chip or a control circuit. The detection device may be disposed on the printed circuit board 32. As shown in FIG. 62, the fourth first connection contacts 34 on each of the top and bottom surfaces of the printed circuit board 32 are divided into connection contacts 341 and 342, which are electrically connected to a judge-turn-on element 370. The conversion controller may be disposed on the printed circuit board 32, or on a printed circuit board 315 having electronic units, as shown in FIG. 46. When the judge-turn-on element 370 on the top surface of the printed circuit board 32 turns on, it is detected that the top surface of the connection board 33 of the printed circuit board 32 serves as the electrical connection surface. At this time, the conversion controller converts into the trace serial numbers of the connection contacts on the surface and the connection contacts are electrically connected to the electronic unit. On the contrary, when the judge-turn-on element 370 on the bottom surface of the printed circuit board 32 turns on, it is detected that the bottom surface of the connection board 33 of the printed circuit board 32 serves as the electrical connection surface. At this time, the conversion controller converts into the trace serial numbers reverse to the trace serial numbers of the connection contacts on the top surface, and the trace serial numbers of the connection contacts are electrically connected to the electronic unit.

The detection device may only be disposed on one surface of the printed circuit board 32 (e.g., on the bottom surface of the printed circuit board 32). At this time, when the detection device does not turn on, the conversion controller is set to let the trace serial numbers of the connection contacts on the top surface of the connection board of the printed circuit board 32 be electrically connected to the electronic unit. When the bottom surface of the connection board 33 of the printed circuit board 32 serves as the electrical connection surface and the detection device turns on, the conversion controller is informed to perform the conversion to let the trace serial numbers reverse to those of the connection contacts on the top surface be electrically connected to the electronic unit.

In addition, the trace serial numbers of the one row of second connection contacts 53 with the USB 3.0 specification include two pairs of signal traces and require the high-frequency transmission, while the one row of first connection contacts 34 do not highly require the high-frequency transmission. So, the trace serial numbers of the two rows of first connection contacts 34 are designed to be arranged reversely, and the same trace serial numbers of the two rows of first connection contacts are electrically connected together to form a cascaded set, so that the two rows of first connection contacts 34 do not need the conversion controller to perform the trace serial number conversion, and the design of the conversion controller can be simplified.

Figure 63:
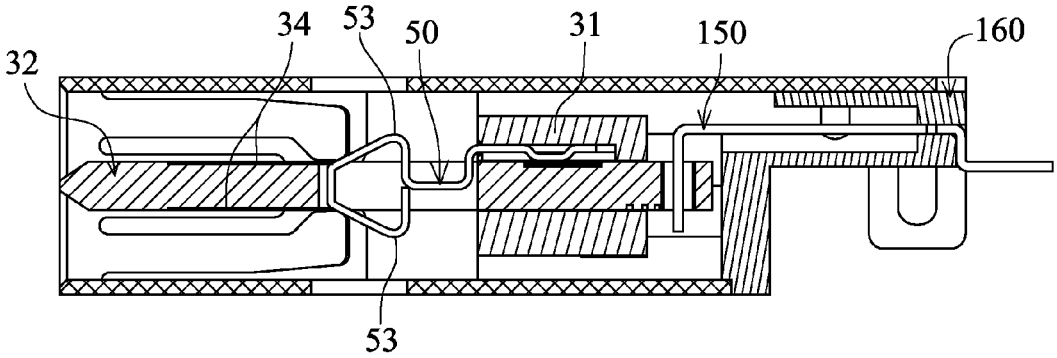
FIG. 63 is a cross-sectional side view showing a 31st embodiment of the invention.

As shown in FIG. 63, a duplex male electrical connector with the USB 3.0 specification according to the $31^{st}$ embodiment of the invention is substantially the same as that of the $30^{th}$ embodiment except for the difference that the two rows of second connection contacts 53 are shared terminals. That is, only one row of second terminals 50 are provided, and each second terminal 50 has two second connection contacts 53 projecting from the top and bottom surfaces of the printed circuit board 32. In addition, the trace serial numbers of the two rows of first connection contacts 34 are arranged reversely, and the same trace serial numbers of the two rows of first connection contacts 34 are electrically connected together to form a cascaded set. Thus, the two rows of first connection contacts 34 may not need the conversion controller to perform the trace serial number conversion, and only the trace serial numbers of the two rows of second connection contacts 53 need the conversion controller to perform the trace serial number conversion, so that the design of the conversion controller can be simplified.

Figure 64:
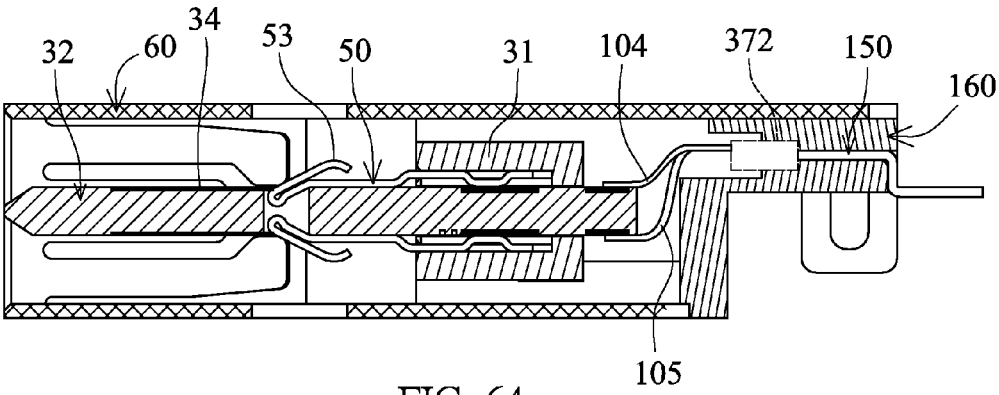
FIG. 64 is a cross-sectional side view showing a 32nd embodiment of the invention.
Figure 65:
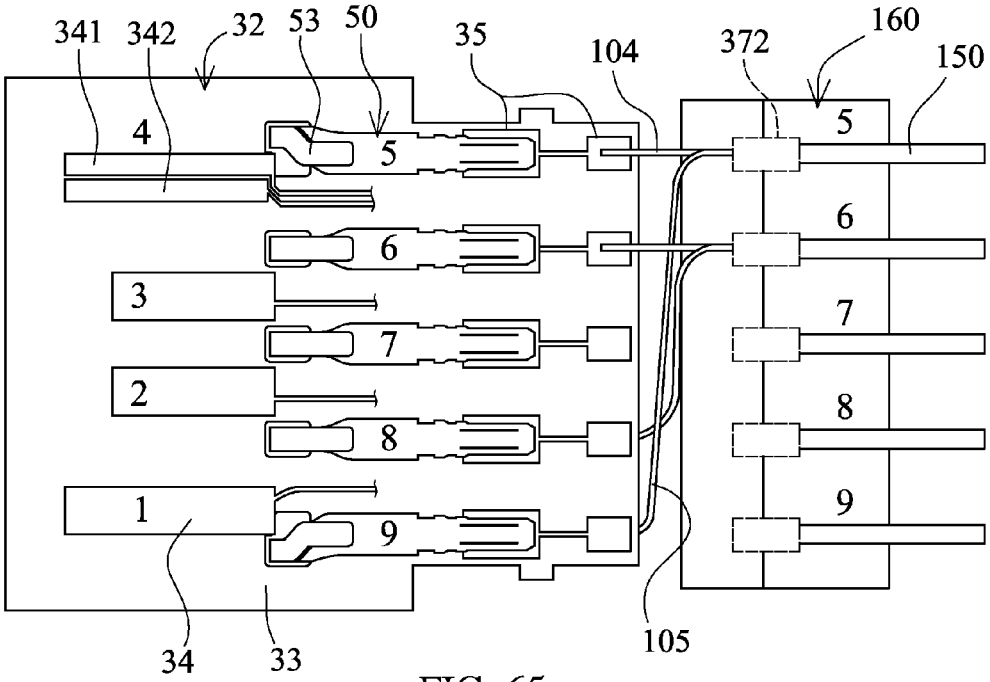
FIG. 65 is a top view showing a printed circuit board according to the 32nd embodiment of the invention.
Figure 66:
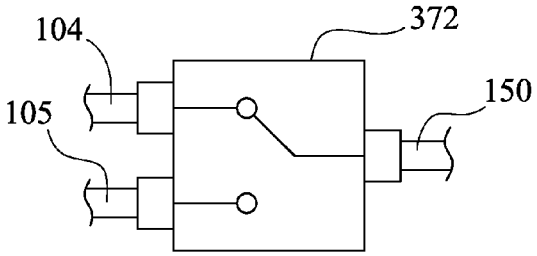
FIG. 66 is a schematic illustration showing a switch controller according to the 32nd embodiment of the invention.

As shown in FIGS. 64 and 65, a duplex male electrical connector with the USB 3.0 specification according to the $32^{nd}$ embodiment of the invention is substantially the same as that of the $28^{th}$ embodiment, in which the trace serial numbers of the two rows of first connection contacts are arranged reversely and the trace serial numbers of the two rows of second connection contacts are arranged reversely, except for the difference that the two rows of first connection contacts 34 are not cascaded and the two rows of second connection contacts 53 are not cascaded. Nine wires 104 and 105 are reversely arranged and respectively connected to the one row of connection terminals 150. The wires 104 are connected to the top surface of the printed circuit board 32, and the wires 105 are connected to the bottom surface of the printed circuit board 32. The wires 104 and 105 connected to the two rows of second connection contacts 53 are firstly connected to switch controllers 372 and then to connection terminals 150. As shown in FIG. 65, the trace serial numbers 5 and 6 on the top and bottom surfaces of the printed circuit board 32 are shown to be cascaded. As shown in FIG. 66, the switch controller 372 can perform the switching, and the switch controller 372 may have an electronic element, such as a switch, a circuit or a chip. In addition, the printed circuit board 32 is also similar to the $30^{th}$ embodiment and has a detection device. The detection device can detect which surface of the connection board 33 of the printed circuit board 32 serves as the electrical connection surface, and thus can control the switch controller 372 to turn on the traces on the surface and to turn off the traces on the other side. Thus, the electrical signals of the five second connection contacts 53 on the surface cannot reversely flow to the other surface, and the high-frequency transmission requirement can be achieved.

Figure 67:
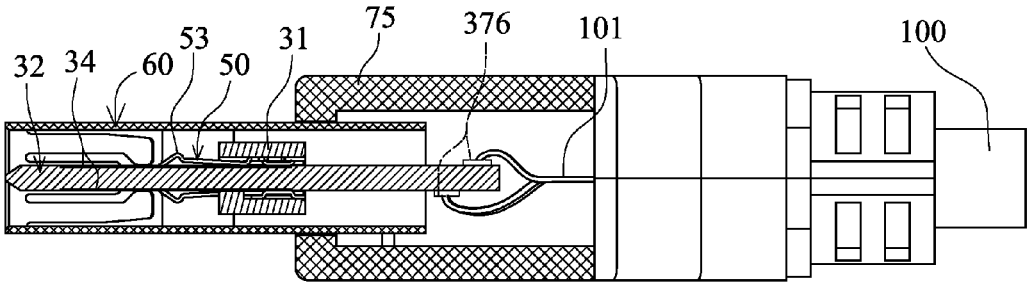
FIG. 67 is a cross-sectional side view showing a 33rd embodiment of the invention.
Figure 68:
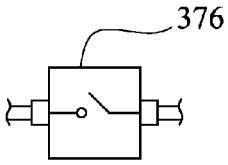
FIG. 68 is a schematic illustration showing a switch controller according to the 33rd embodiment of the invention.

As shown in FIG. 67, a duplex electrical-connection electric cable with the USB 3.0 specification according to the $33^{rd}$ embodiment of the invention is substantially the same as those of the $22^{nd}$ and $27^{th}$ embodiments except for the difference that the trace serial numbers of the two rows of first connection contacts 34 of the top and bottom surfaces of the printed circuit board 32 are arranged reversely and the two rows of first connection contacts 34 are not cascaded, the trace serial numbers of the two rows of second connection contacts 53 are arranged reversely and the two rows of second connection contacts 53 are not cascaded. Each of the nine wires 101 of the connection cable 100 is divided into two lines, and the nine wires 101 are reversely arranged and connected to the two rows of first connection contacts 34 and the two rows of second connection contacts 53 on the top and bottom surfaces of the printed circuit board 32. The two rows of second connection contacts 53 are electrically connected to switch controllers 376. As shown in FIG. 68, the switch controller 376 may have an electronic element, such as a switch, a circuit or a chip. In addition, the printed circuit board 32 is also similar to that of the $30^{th}$ embodiment and has a detection device. The detection device can detect which surface of the connection board of the printed circuit board 32 serves as the electrical connection surface, and thus control the switch controllers 376 on the surface to turn on, and the switch controllers 376 on the other surface to turn off. Thus, the electrical signals of the five second connection contacts 53 on the surface cannot reversely flow to the other surface, and the high-frequency transmission requirement can be achieved.

Figure 69:
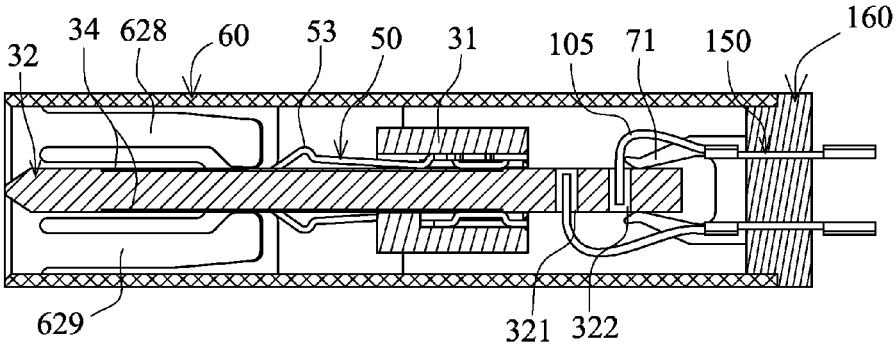
FIG. 69 is a cross-sectional side view showing a 34th embodiment of the invention.

As shown in FIG. 69, a duplex male electrical connector with the USB 3.0 specification according to the 34$^{th}$ embodiment of the invention is substantially the same as that of the 22$^{nd}$ embodiment except for the difference that the rear stopper block 160 has at least one elastic returning sheet 71 and two rows of connection terminals 150, and the elastic returning sheet 71 has two elastic arms that can elastically press the top and bottom surfaces of the rear section of the printed circuit board 32. The two rows of connection terminals 150 are divided into the upper row of five connection terminals and the lower row of four connection terminals. The trace serial numbers of the two rows of first connection contacts 34 are arranged reversely, and the trace serial numbers are electrically connected together to form a cascaded set and connected to one row of four connection holes 321. The trace serial numbers of the two rows of second connection contacts 53 are arranged reversely, and the same trace serial numbers are electrically connected together to form another cascaded set and connected to one row of five connection holes 322. The one row of four connection holes 321 are electrically connected to the lower row of four connection terminals 150 through the wires 105, and the one row of five connection holes 322 are electrically connected to the upper row of five connection terminals 150 through the wires 105.

Figure 70:
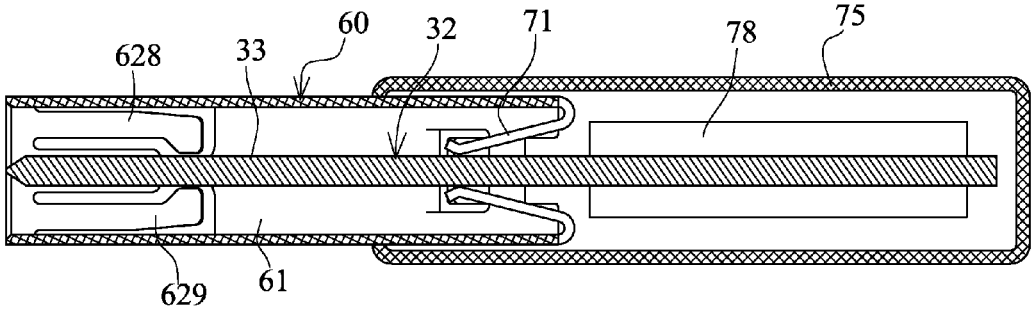
FIG. 70 is a cross-sectional side view showing a 35th embodiment of the invention.
Figure 71:
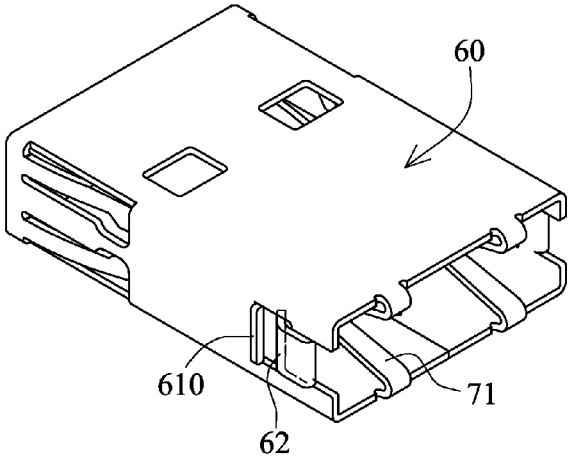
FIG. 71 is a pictorial view showing a socket shell according to the 35th embodiment of the invention.

As shown in FIGS. 70 and 71, the 35$^{th}$ embodiment of the invention is substantially the same as the eighth embodiment except for the difference that this embodiment is similar to the 17$^{th}$ embodiment and has one pair of upper and lower position restricting and elastic returning sheets 628 and 629 disposed on each of two sides of the front section of the socket shell 60, and an outwardly projecting engaging portion 610 disposed on each of two sides of the rear section of the socket shell 60, wherein the engaging portion 610 may engage with the external casing 75.

Figure 72:
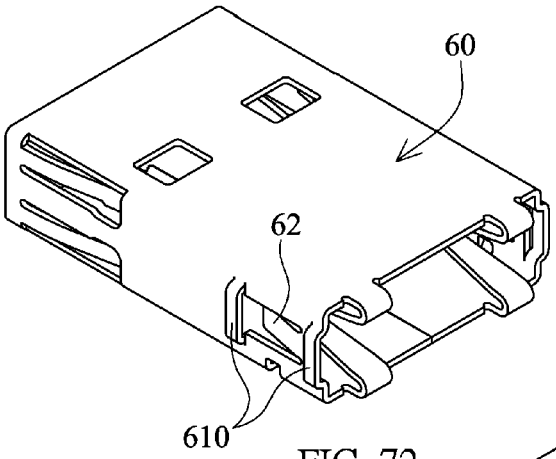
FIG. 72 is a pictorial view showing a socket shell according to a 36th embodiment of the invention.

As shown in FIG. 72, the 36$^{th}$ embodiment of the invention is substantially the same as the 35$^{th}$ embodiment except for the difference that this embodiment has two outwardly projecting engaging portions 610 disposed on each of two sides of the rear section of the socket shell 60, wherein the engaging portion 610 may engage with the external casing 75.

Figure 73:
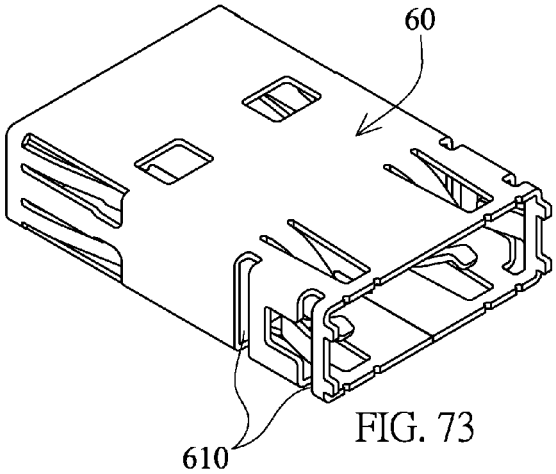
FIG. 73 is a pictorial view showing a socket shell according to a 37th embodiment of the invention.

As shown in FIG. 73, the 37$^{th}$ embodiment of the invention is substantially the same as the 35$^{th}$ embodiment except for the difference that this embodiment has two grooved engaging portions 610 disposed on each of two sides of the rear section of the socket shell 60, wherein the engaging portion 610 may engage with the external casing 75.

Figure 74:
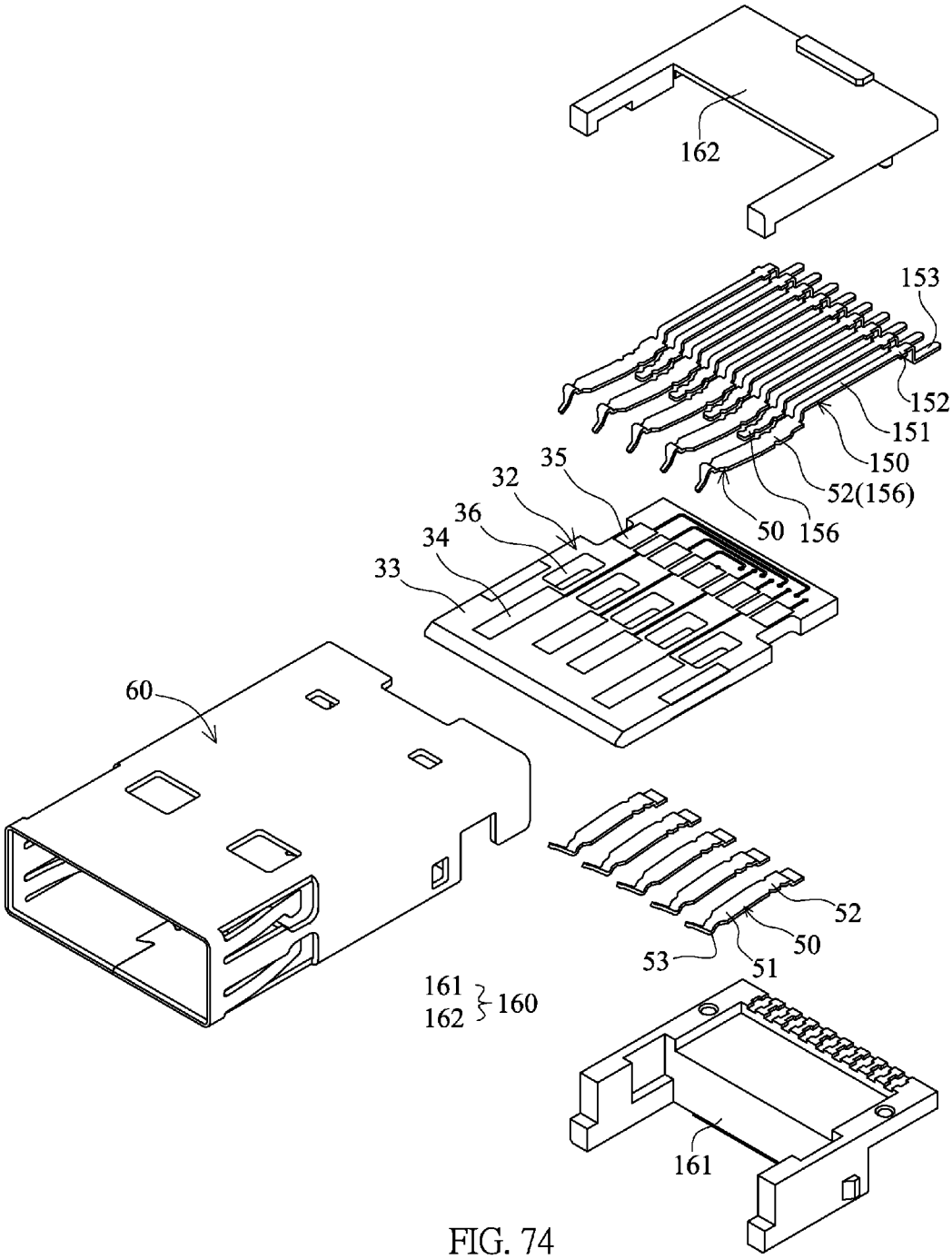
FIG. 74 is a pictorially exploded view showing a 38th embodiment of the invention.
Figure 75:
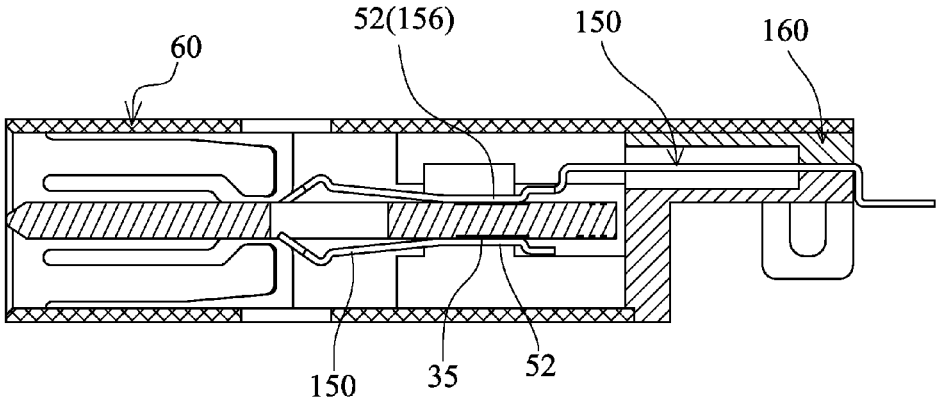
FIG. 75 is a cross-sectional side view showing the 38th embodiment of the invention.

As shown in FIGS. 74 and 75, a duplex male electrical connector with the USB 3.0 specification according to the 38$^{th}$ embodiment of the invention is substantially the same as that of the 19$^{th}$ embodiment except that this embodiment has no plastic seat 31 for fixing the two rows of second terminals 50 and the one row of connection terminals 150. The pins 52 of the two rows of second terminals 50 are also fixing portions. The two rows of second terminals 50 are directly bonded and fixed to the bonding pads 35 of the printed circuit board 32 using the pins 52. The contacts 156 on the front ends of the one row of connection terminals 150 are also fixing portions directly bonded and fixed to the bonding pads 35 of the printed circuit board 32. Similarly, five of the one row of connection terminals 150 are integrally connected to five of the upper row of second terminals 50.

Figure 76:
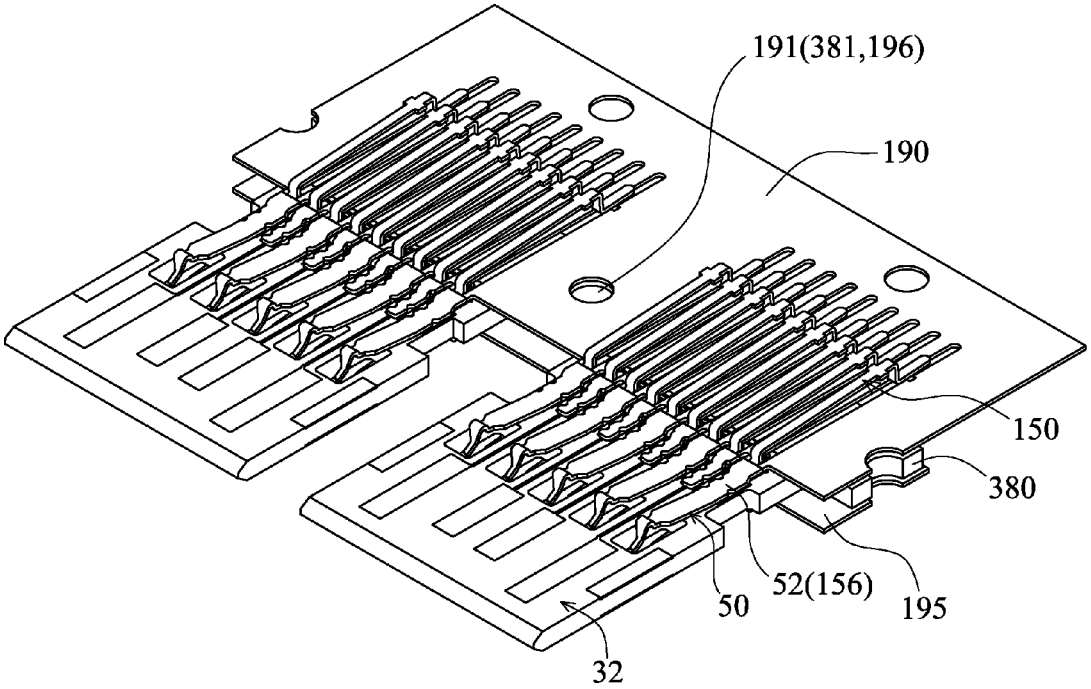
FIG. 76 is a schematically pictorially assembled view showing manufacturing of the 38th embodiment of the invention.
Figure 77:
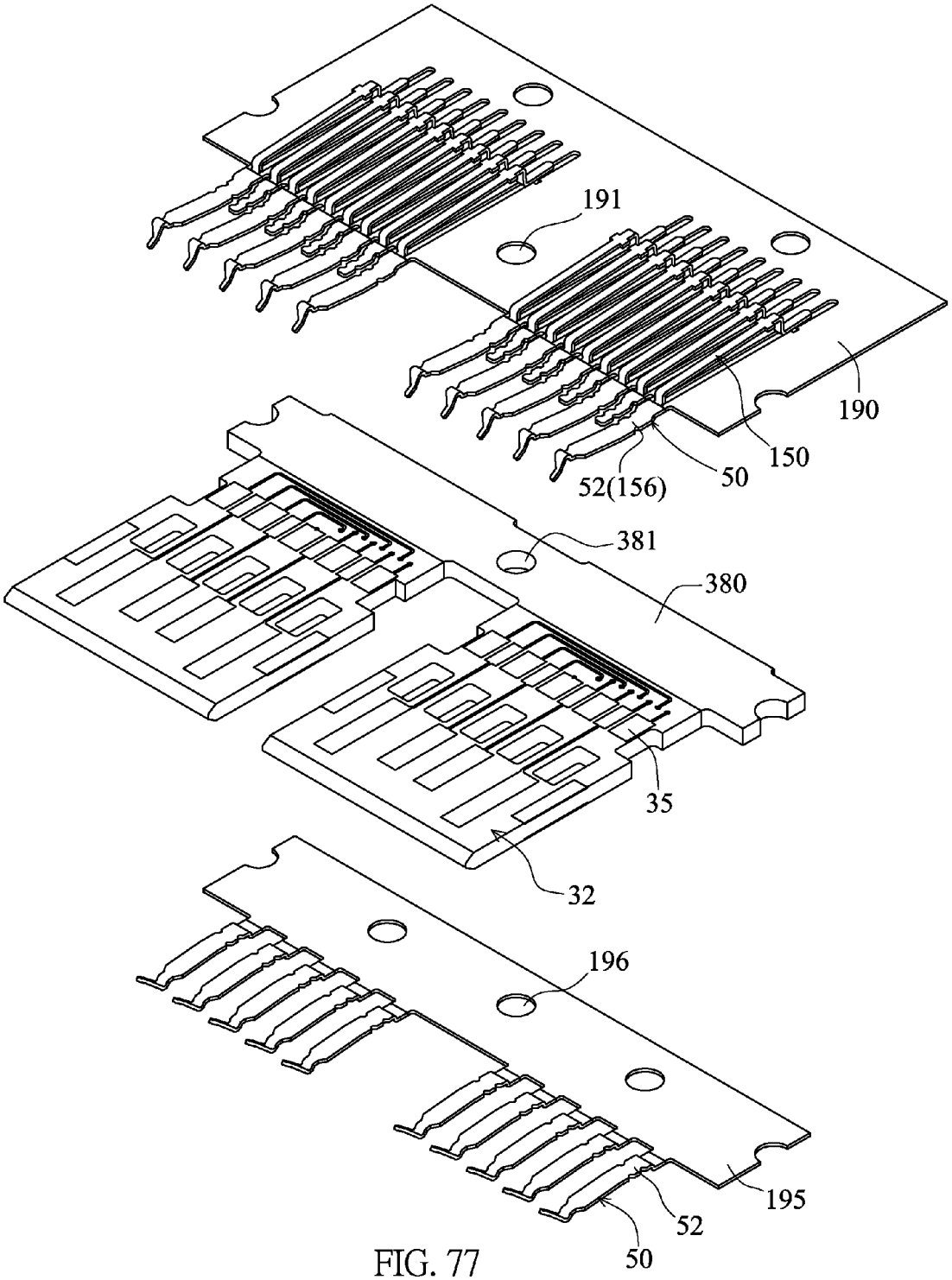
FIG. 77 is a schematically pictorially exploded view showing manufacturing of the 38th embodiment of the invention.

Regarding the manufacturing processes, as shown in FIGS. 76 and 77, the printed circuit board 32 is firstly integrally connected to a material tape 380 without being cut, and the material tape 380 has positioning holes 381, the upper row of second terminals 50 and the one row of connection terminals 150 are connected to a material tape 190. The material tape 190 has positioning holes 191, and the lower row of second terminals 50 are connected to a material tape 195 having positioning holes 196. As shown in FIG. 76, the material tape 190, the material tape 380 and the material tape 195 are stacked in the vertical direction, and a jig is provided to position the material tape 190, the material tape 380 and the material tape 195 through the positioning holes 191, 381 and 196, so that the two rows of second terminals 50 and the one row of connection terminals 150 are bonded to the printed circuit board 32. Finally, the material tapes 190 and 195 are broken, and the material tape 380 is cut away.

Figure 78:
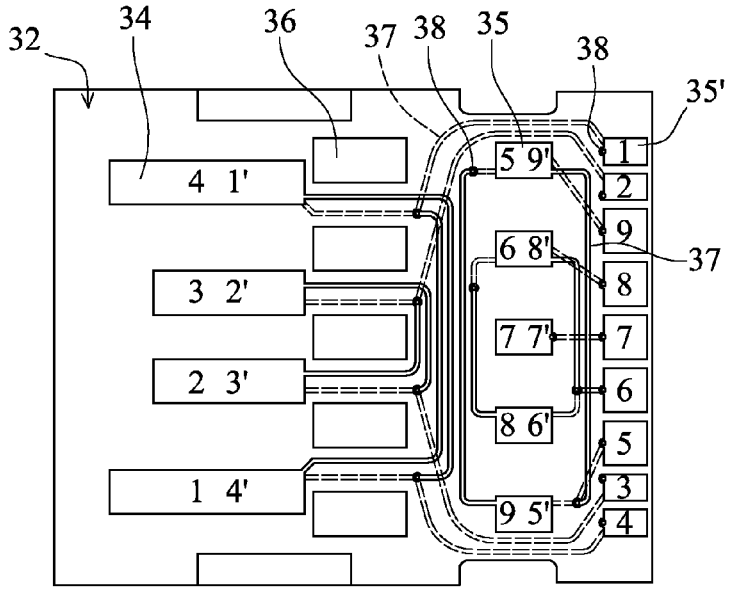
FIG. 78 is a top view showing a printed circuit board according to a 39th embodiment of the invention.
Figure 79:
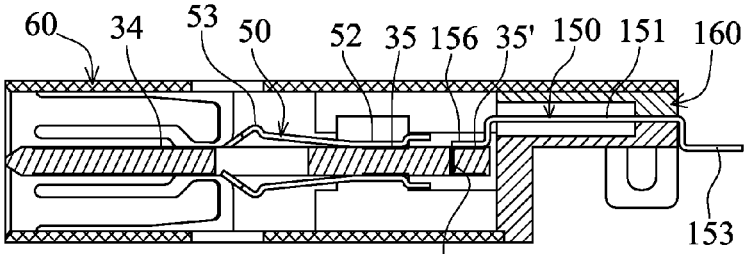
FIG. 79 is a cross-sectional side view showing the 39th embodiment of the invention.

As shown in FIGS. 78 and 79, a duplex male electrical connector with the USB 3.0 specification according to the 39$^{th}$ embodiment of the invention is substantially the same as that of the 38$^{th}$ embodiment except that the cascaded traces of the connection contacts of the top and bottom surfaces of the printed circuit boards of the two embodiments have different layouts. Similarly, the trace serial numbers of the two rows of first connection contacts 34 of this embodiment are also arranged reversely, the trace serial numbers of the two rows of second connection contacts 53 are arranged reversely, the trace serial numbers on the top surface of the printed circuit board 32 are denoted by 1 to 9, and the trace serial numbers on the bottom surface of the printed circuit board 32 are denoted by 1' to 9'. The same trace serial numbers of the two rows of first connection contacts 34 are electrically connected together through the conductive traces 37 and the conductive through holes 38 to form a cascaded set. The same trace serial numbers of the two rows of second connection contacts 53 are electrically connected together through the traces 37 and the electroconductive through holes 38 to form another cascaded set. The traces 37 depicted by dashed lines in the drawing represent the traces on the bottom surface of the printed circuit board. The two rows of second terminals 50 are bonded to the bonding pads 35 of the top and bottom surfaces of the printed circuit board 32, and the one row of connection terminals 150 are bonded to the bonding pads 35' on the top surface of the printed circuit board 32. As shown in the drawing, it is obtained that the cascaded traces of the two rows of first connection contacts 34 are paired and respectively disposed on two sides of the cascaded traces of the two rows of second connection contacts 53, so that the better high-frequency transmission effect can be obtained.

Figure 80:
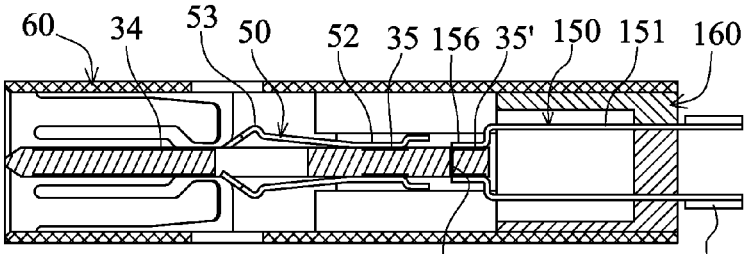
FIG. 80 is a cross-sectional side view showing a 40th embodiment of the invention.

As shown in FIG. 80, the 40$^{th}$ embodiment of the invention is substantially the same as the 39$^{th}$ embodiment except for the difference that this embodiment has nine connection terminals 150 arranged in two rows respectively bonded to the bonding pads 35' of the top and bottom surfaces of the printed circuit board 32, so that the pins 153 extending out of the rear end of the rear stopper block 160 are arranged in upper and lower rows. The upper row contains five pins and the lower row contains four pins. Alternatively, the upper row contains four pins and the lower row contains five pins. This embodiment mainly serves as the duplex male electrical connector of the electric cable to achieve the better high-frequency transmission effect.

Figure 81:
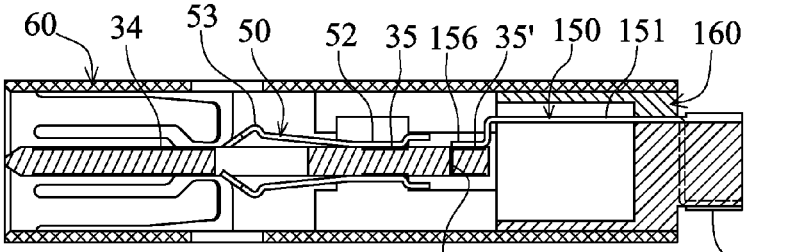
FIG. 81 is a cross-sectional side view showing a 41st embodiment of the invention.

As shown in FIG. 81, the 41$^{st}$ embodiment of the invention is substantially the same as the 39$^{th}$ embodiment except for the difference that this embodiment have nine contacts 56 of the nine connection terminals 150 arranged in one row and bonded to the bonding pads 35' on the top surface of the printed circuit board 32. The pins 153 may be arranged in upper and lower rows. The upper row contains five pins and the lower row contains four pins. Alternatively, the upper row contains four pins and the lower row contains five pins.

Figure 82:
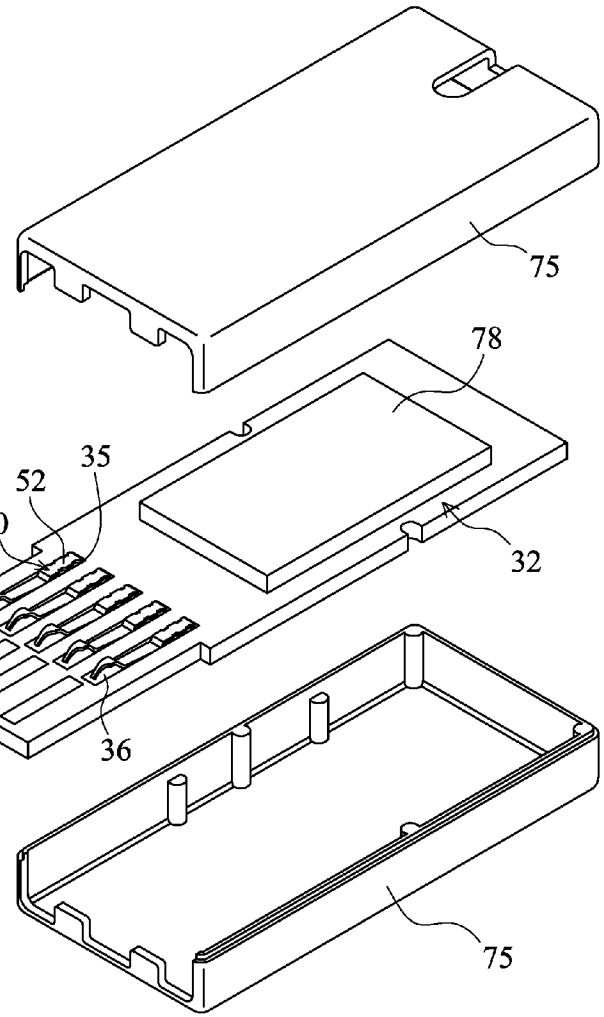
FIG. 82 is a pictorially exploded view showing a 42nd embodiment of the invention.
Figure 83:
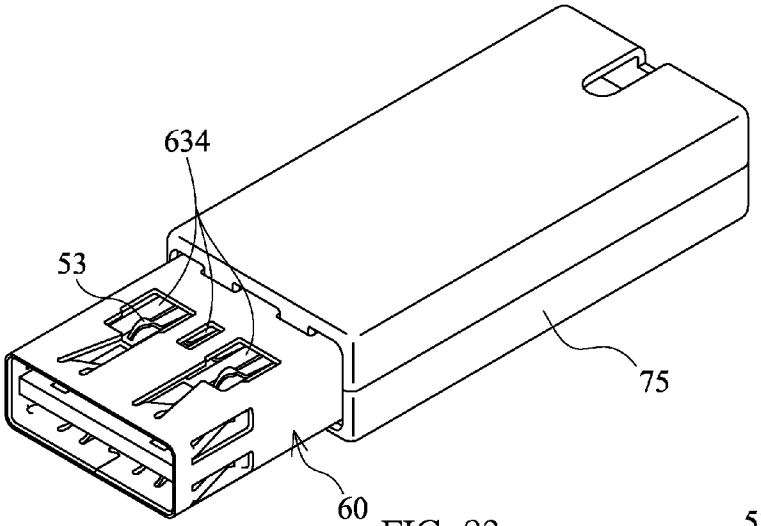
FIG. 83 is a pictorially assembled view showing the 42nd embodiment of the invention.
Figure 84:
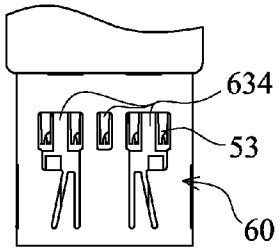
FIG. 84 is a top view showing the 42nd embodiment of the invention.

As shown in FIGS. 82 to 84, the 42$^{nd}$ embodiment of the invention is substantially the same as the first embodiment except for the difference that this embodiment has the pins 52 of the two rows of second terminals 50 directly bonded and fixed to the bonding pads 35 on the top and bottom surfaces of the printed circuit board 32. The second terminal 50 can be vertically elastically moved and has a second connection contact 53 projecting from one surface of the connection board. The printed circuit board 32 has through slots 36 allowing the second terminals 50 to be vertically elastically moved. Through slots 634 are disposed on the top and bottom surfaces of the socket shell 60 and accommodate the projecting second connection contacts 53 of the two rows of second terminals 50 to prevent the short-circuited condition.

Figure 85:
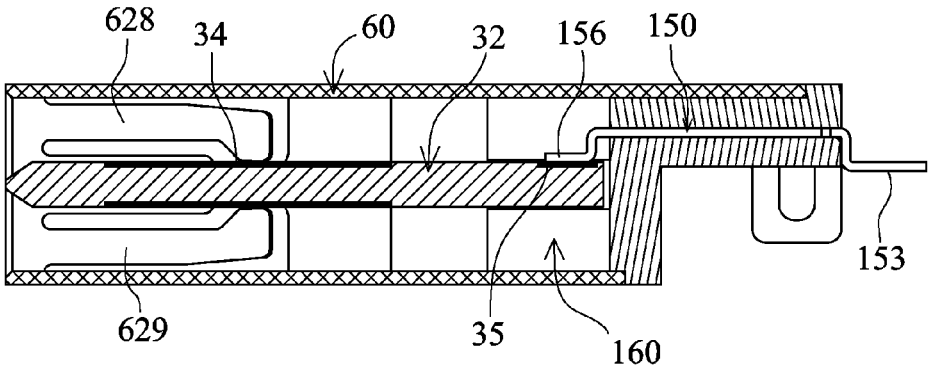
FIG. 85 is a cross-sectional side view showing a 43rd embodiment of the invention.
Figure 86:
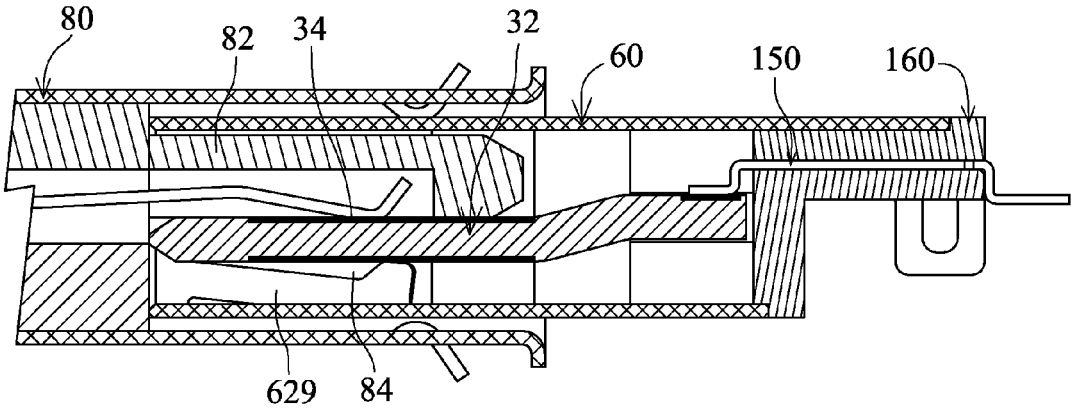
FIG. 86 is a cross-sectional side view showing the used state of the 43rd embodiment of the invention.

As shown in FIGS. 85 and 86, the 43$^{rd}$ embodiment of the invention is substantially the same as the 28$^{th}$ embodiment except for the difference that the two sides of the rear end of the printed circuit board 32 of this embodiment are positioned by the two sides of the rear stopper block 160 and cannot vertically float and move relative to the socket shell, and the contact 156 of the front end of the connection terminal 150 are horizontally bonded to the bonding pad 35 on the top surface of the printed circuit board 32.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. A duplex male electrical connector, which can be bidirectionally inserted into a female socket for electrical connection, the duplex male electrical connector comprising:

an insulating base having a front section formed with a connection board, the connection board having opposite top and bottom surfaces;

two rows of first connection contacts disposed on the top and bottom surfaces of the connection board, respectively; and a socket shell, which is formed with a connection slot having a front end serving as an insert port, the connection board being disposed in the connection slot, wherein the insulating base comprises a plastic seat and a printed circuit board, top and bottom surfaces of the printed circuit board are combined with the plastic seat, a front section of the printed circuit board projects from the plastic seat to form the connection board, and the two rows of first connection contacts are circuit connection contacts, wherein the socket shell and the connection board can vertically move relative to each other, such that the connection board can vertically move relative to the socket shell or the socket shell can vertically move relative to the connection board.

2. The connector according to claim 1, wherein the socket shell is made of a metal material.

3. The connector according to claim 1, wherein a front end of the connection board is formed with upper and lower inclined guiding surfaces and is tapered.

4. The connector according to claim 1, wherein an anti-retrogression structure is disposed between the socket shell and the insulating base, so that retrogression can be avoided after the insulating base is assembled with the socket shell.

5. The connector according to claim 1, further comprising an external casing, which is disposed outside a rear section of the socket shell and a rear section of the insulating base.

6. The connector according to claim 1, wherein the insulating base is made of a hard material and cannot be distorted, and the overall insulating base from a front end to a rear end and the socket shell can vertically float and move relative to each other.

7. The connector according to claim 1, further comprising two rows of second terminals, wherein one row of electroconductive portions are disposed on each of top and bottom surfaces of the printed circuit board, the second terminal has an extension and a pin, the extension has a second connection contact that can be elastically vertically moved, the pins of the two rows of second terminals are bonded to the electroconductive portions on the top and bottom surfaces of the printed circuit board, respectively, the second connection contacts of the two rows of second terminals respectively project from the top and bottom surfaces of the connection board, and the second connection contact is disposed in back of the first connection contact.

8. The connector according to claim 7, wherein the connection board has through slots which enable the two rows of second terminals to be elastically moved vertically.

9. The connector according to claim 8, wherein inclined guiding surfaces with narrower plate surfaces are disposed on front ends of the second connection contacts of the two rows of second terminals, the second connection contacts of the two rows of second terminals correspond to each other vertically, and the inclined guiding surfaces of the two rows of second terminals are staggered in a left-to-right direction, so that the two rows of second terminals cannot touch each other when the two rows of second terminals are elastically moved vertically.

10. The connector according to claim 7, wherein trace serial numbers of the two rows of first connection contacts are arranged reversely, trace serial numbers of the two rows of second connection contacts are arranged reversely, the same trace serial numbers of the two rows of first connection contacts are electrically connected together to form a cascaded set, and the same trace serial numbers of the two rows of second connection contacts are electrically connected together to form another cascaded set.

11. The connector according to claim 7, wherein each of the two rows of first connection contacts contain four contacts, each of the two rows of second connection contacts contain five contacts, and the one row of first connection contacts and the one row of second connection contacts form a USB 3.0 contact interface.

12. A duplex male electrical connector, which can be bidirectionally inserted into a female socket for electrical connection, the duplex male electrical connector comprising:

an insulating base having a front section formed with a connection board, the connection board having opposite top and bottom surfaces;

two rows of first connection contacts disposed on the top and bottom surfaces of the connection board, respectively;

a socket shell, which is formed with a connection slot having a front end serving as an insert port, the connection board being disposed in the connection slot, wherein the connection board in the socket shell and the connection board can vertically move relative to each other, such that the connection board can vertically move relative to the socket shell or the socket shell can vertically move relative to the connection board; and a returning structure, which is disposed between the socket shell and the insulating base, so that the connection board returns to a middle-range position of a height of the connection slot with the connection board being separated from the socket shell.

13. The connector according to claim 12, wherein the returning structure returns the connection board to a middle position of the height of the connection slot.

14. The connector according to claim 12, wherein the returning structure comprises elastic returning sheets, which are integrally connected to the socket shell and can be elastically vertically moved.

15. The connector according to claim 14, wherein the elastic returning sheets are symmetrically disposed on top and bottom surfaces of a rear section of the insulating base, symmetrically disposed on the top and bottom surfaces of the connection board or symmetrically disposed on the top and bottom surfaces of the rear section of the insulating base and the top and bottom surfaces of the connection board, wherein the elastic returning sheets symmetrically disposed on the top and bottom surfaces of the connection board inwardly and forwardly integrally extend from the insert port of the connection slot to distal ends and to be open.

16. A duplex male electrical connector, which can be bidirectionally inserted into a female socket for electrical connection, the duplex male electrical connector comprising:

an insulating base having a front section formed with a connection board, the connection board having opposite top and bottom surfaces;

two rows of first connection contacts disposed on the top and bottom surfaces of the connection board, respectively;

a socket shell, which is formed with a connection slot having a front end serving as an insert port, the connection board being disposed in the connection slot, wherein the socket shell and the connection board can vertically float and move relative to each other, such that the connection board can vertically float and move relative to the socket shell or the socket shell can vertically float and move relative to the connection board; and a position restricting structure, which restricts the connection board or an end section of the insulating base at a position within a middle section of a height of the socket shell.

17. The connector according to claim 16, wherein the position restricting structure has multiple pairs of upper and lower position restricting sheets, which are integrally connected to two side surfaces of the socket shell and project toward the connection slot, each of the pairs of the upper and lower position restricting sheets have a height difference, the insulating base is disposed between each of the pairs of the upper and lower position restricting sheets, and the height difference corresponds to a movable region of the insulating base.

18. The connector according to claim 17, wherein:

the upper and lower position restricting sheets inwardly and forwardly integrally extend from the insert port of the connection slot to distal ends and to be open, and the upper and lower position restricting sheets can be elastically moved laterally;

the upper and lower position restricting sheets are formed by pressing two side surfaces of the socket shell to form notches on the two side surfaces of the socket shell or by directly inversely bending the two side surfaces of the socket shell inwards;

when the duplex male electrical connector is inserted into a female socket and the upper position restricting sheets are pushed by the female socket toward one side, the lower position restricting sheets can restrict and rest against the connection board; and when the duplex male electrical connector is inserted into the female socket reversely and the lower position restricting sheets are pushed by the female socket toward one side, the upper position restricting sheets can restrict and rest against the connection board.

* * * * *